US010814237B2

(12) United States Patent
Atcheson

(10) Patent No.: US 10,814,237 B2
(45) **Date of Patent: *Oct. 27, 2020**

(54) TOY VEHICLE AND TRACK SYSTEM THEREFOR

(71) Applicant: Smartrtoys Limited, Chai Wan (HK)

(72) Inventor: Geoffrey Ronald Atcheson, Chai Wan (HK)

(73) Assignee: Smartrtoys Limited, Chai Wan (HK)

( * ) Notice: Subject to any disclaimer, the term of this patent is extended or adjusted under 35 U.S.C. 154(b) by 0 days.

This patent is subject to a terminal disclaimer.

(21) Appl. No.: 16/297,122

(22) Filed: Mar. 8, 2019

(65) Prior Publication Data

US 2019/0201799 A1 Jul. 4, 2019

Related U.S. Application Data

(63) Continuation-in-part of application No. 16/329,732, filed as application No. PCT/CN2017/099307 on Aug. 28, 2017.

(30) Foreign Application Priority Data

Aug. 29, 2016 (HK) ..... 16110266.8

(51) Int. Cl.
*A63H 17/26* (2006.01)
*A63H 18/02* (2006.01)

(52) U.S. Cl.
CPC ..... *A63H 17/262* (2013.01); *A63H 18/02* (2013.01)

(58) Field of Classification Search
CPC ..... A63H 17/262; A63H 17/25; A63H 18/02
(Continued)

(56) References Cited

U.S. PATENT DOCUMENTS 3,734,428 A * 5/1973 Alexandrov ..... B65G 51/06 406/185
4,113,202 A * 9/1978 Ueno ..... B65G 51/06 104/138.1

(Continued)

FOREIGN PATENT DOCUMENTS

CN 101229443 A 7/2008
CN 104102221 A 10/2014

(Continued)

OTHER PUBLICATIONS

Yan, Lei, Authorized Officer, State Intellectual Property Office of the P.R. China, "International Search Report" in connection with related International Application No. PCT/CN2017/099307, dated Dec. 4, 2017, 4 pages.

*Primary Examiner* — Vishu K Mendiratta
(74) *Attorney, Agent, or Firm* — Kolisch Hartwell, P.C.

(57) ABSTRACT

A toy vehicle having a longitudinal central axis aligned in a direction of travel and for travel through a passageway of an elongated tubular track having a non-linear pathway which extends in three dimensions and which at least partly confines said toy vehicle, said toy vehicle comprising a first plurality of translational elements comprising two+2n, wherein n=1 or more, translational elements spaced about the longitudinal central axis of the toy vehicle for engagement with the inner surface of the elongated tubular track; and a second plurality of translational elements comprising two+2m, wherein m=1 or more, translational elements spaced about the longitudinal central axis of the toy vehicle for engagement with the curved inner surface of the elongated tubular track, wherein each of the translational elements of the first plurality of translational elements and each of the translational elements of the second plurality of translation elements are independently moveable in relation to each other and are biased in at least an outward radial
(Continued)

direction from the longitudinal central axis of the toy vehicle, and a control system for controlling at least the operable rotational speed of at least two translational elements, wherein said at least two translational elements are drive translational elements.

19 Claims, 20 Drawing Sheets

(58) Field of Classification Search
USPC ..... 446/431; 273/246
See application file for complete search history.

(56) References Cited

U.S. PATENT DOCUMENTS

| | | | | | |
|---|---|---|---|---|---|
| 4,229,005 | A * | 10/1980 | Barlow | A63H 18/002 446/180 |
| 4,585,166 | A * | 4/1986 | Stephens | A63H 18/02 238/10 F |
| 5,193,462 | A * | 3/1993 | Marcu | A63G 7/00 104/138.1 |
| 5,507,679 | A | 4/1996 | Getsay | |
| 7,025,656 | B2 | 4/2006 | Bailey | |
| 2005/0266768 | A1* | 12/2005 | Bailey | A63H 17/14 446/427 |
| 2005/0287916 | A1 | 12/2005 | Sheltman et al. | |
| 2019/0192981 | A1* | 6/2019 | Atcheson | A63H 17/25 |

FOREIGN PATENT DOCUMENTS

| | | | |
|---|---|---|---|
| CN | 104248846 | A | 12/2014 |
| CN | 105833535 | A | 8/2016 |
| WO | 2016050103 | A1 | 4/2016 |

* cited by examiner

Figure 1b (ii)

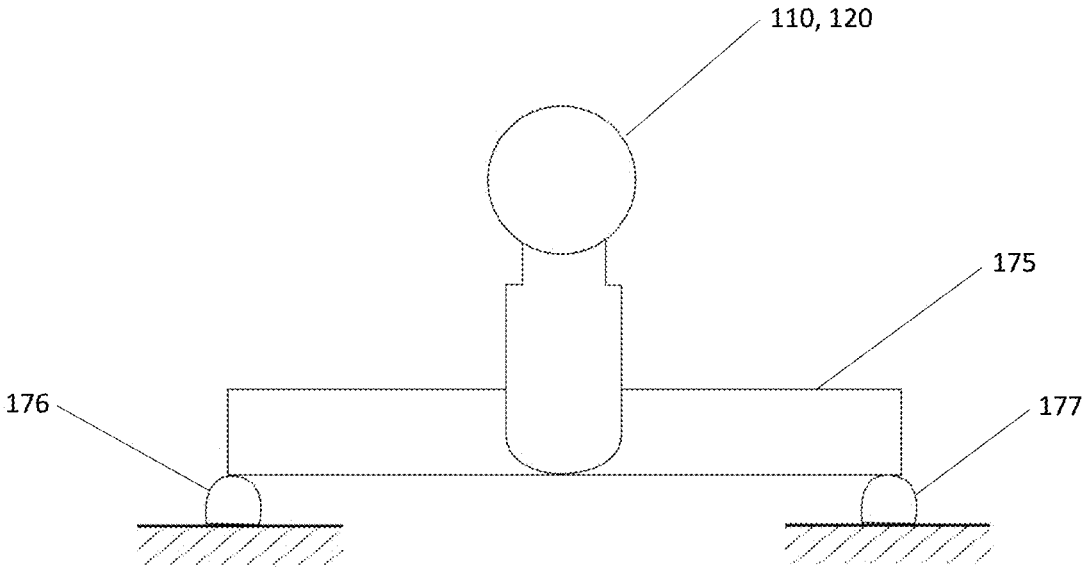
Figure 1d (i)
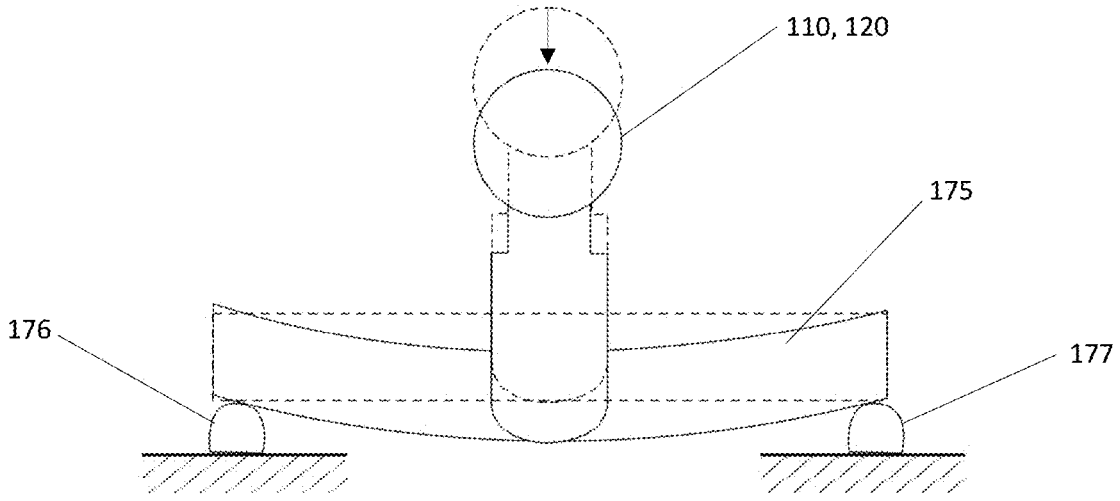
Figure 1d (ii)

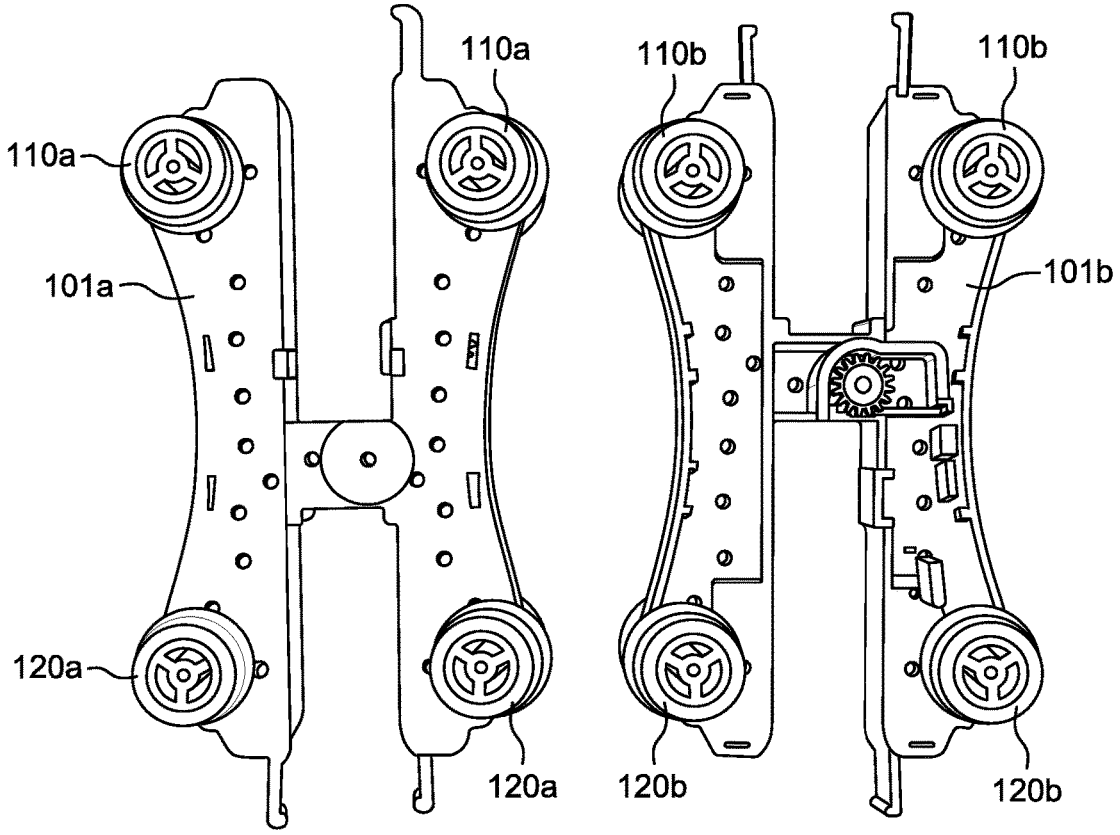
Figure 1e (i)
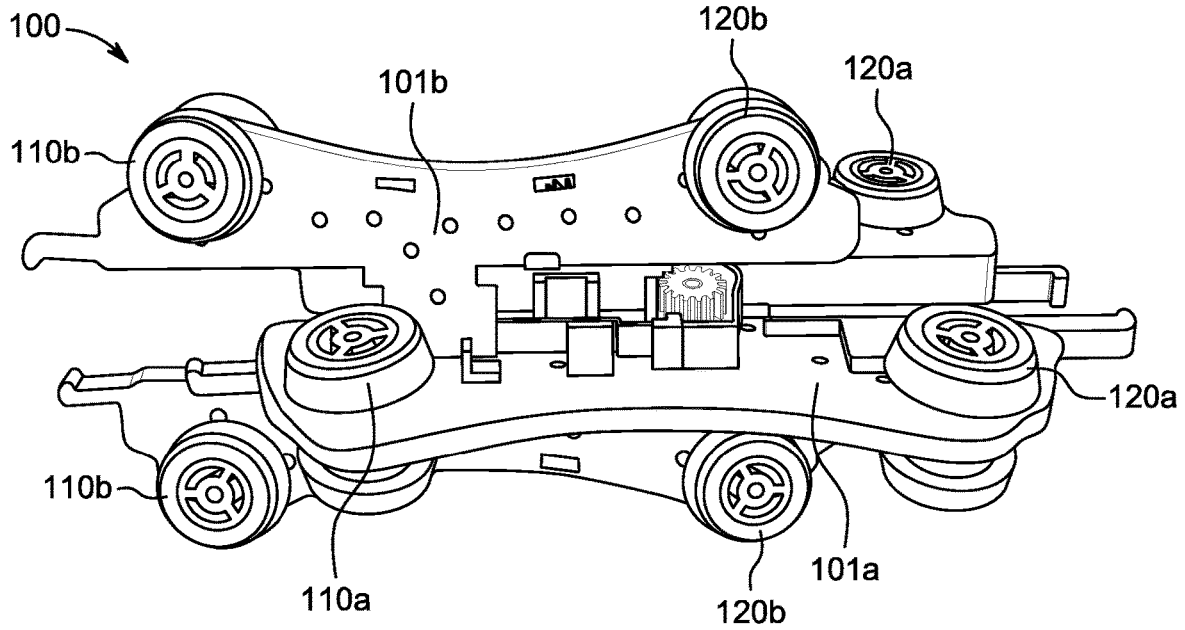
Figure 1e (ii)

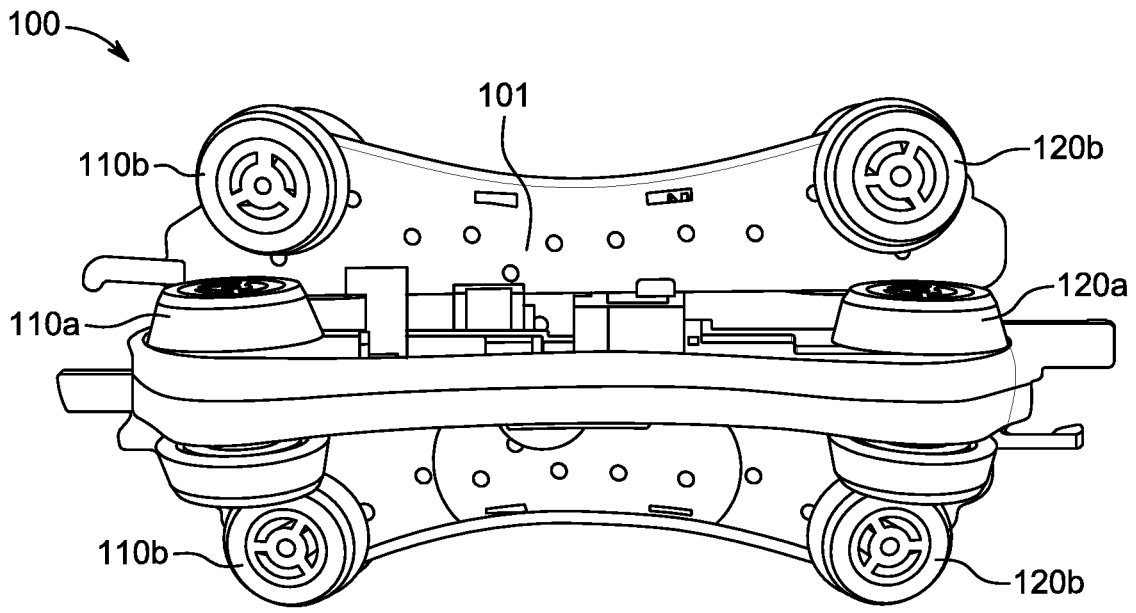
Figure 1e (iii)
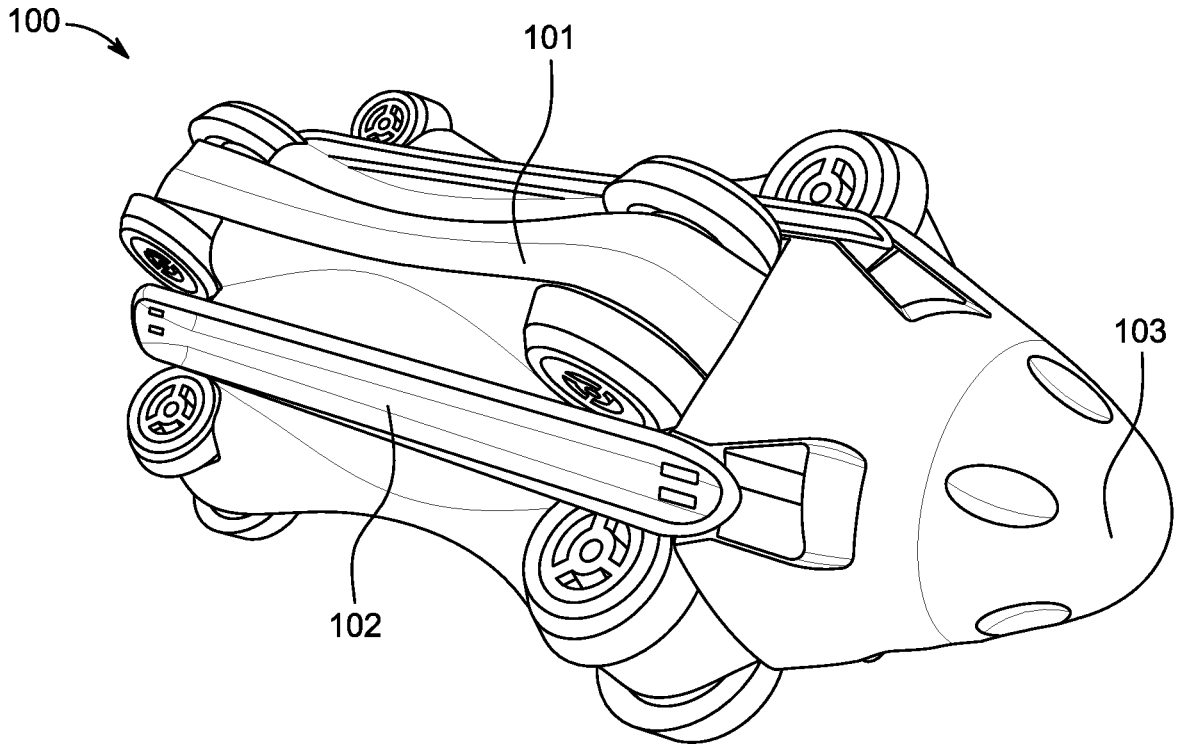
Figure 1e (iv)

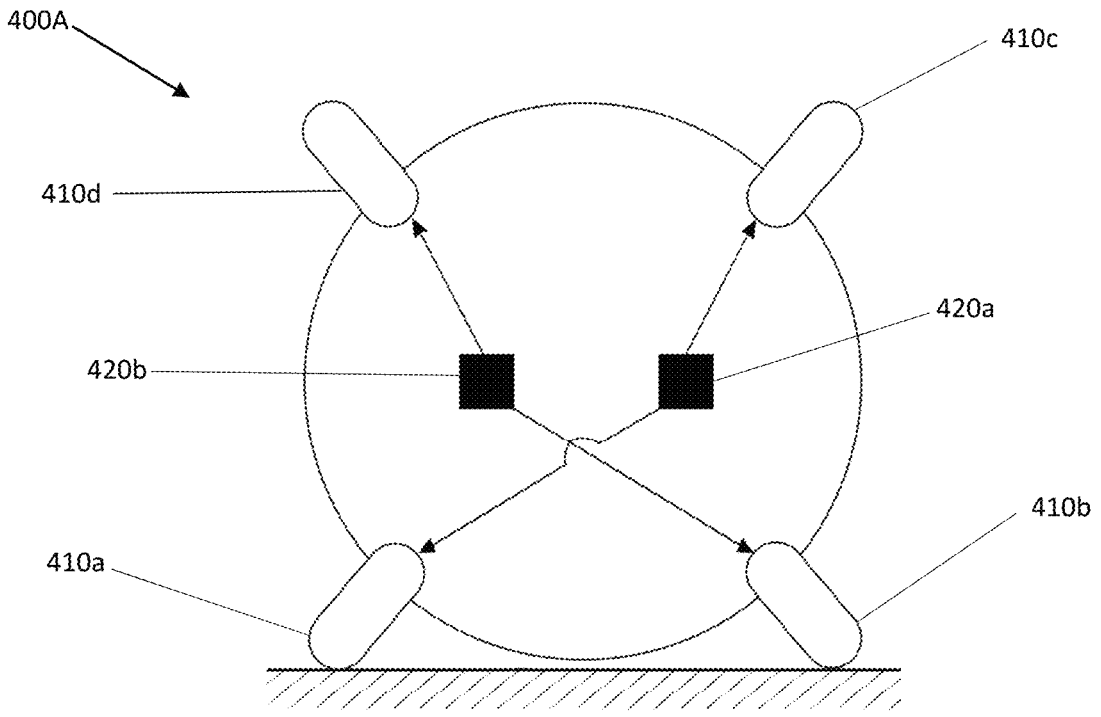
Figure 4a (i)
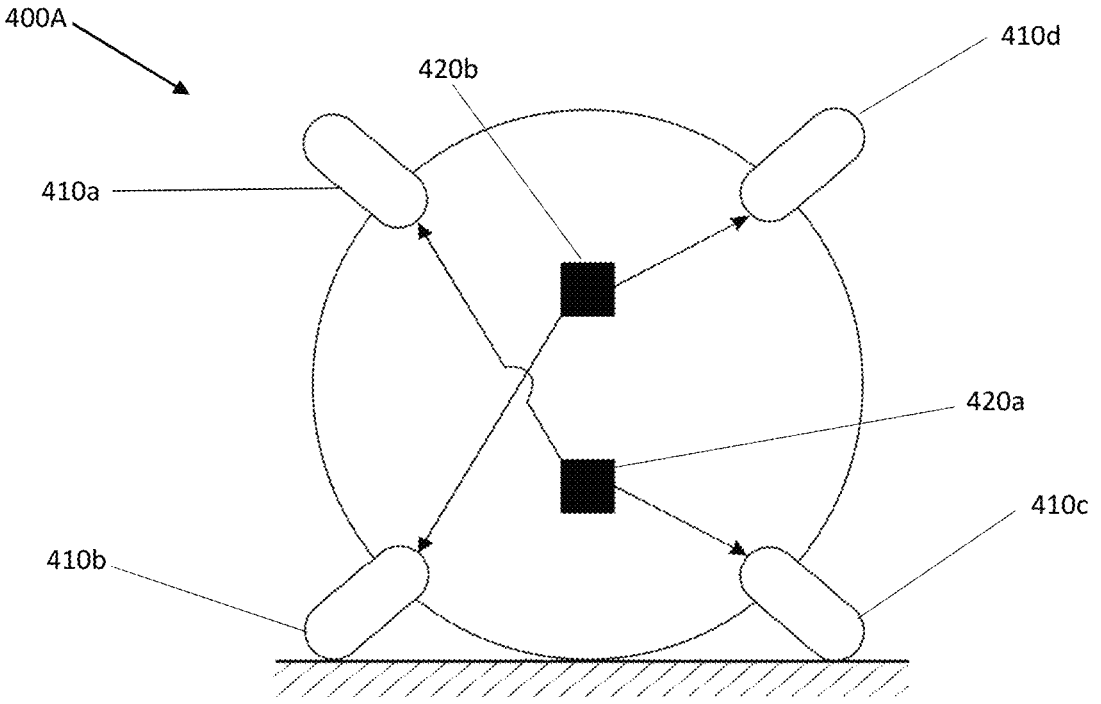
Figure 4a (ii)

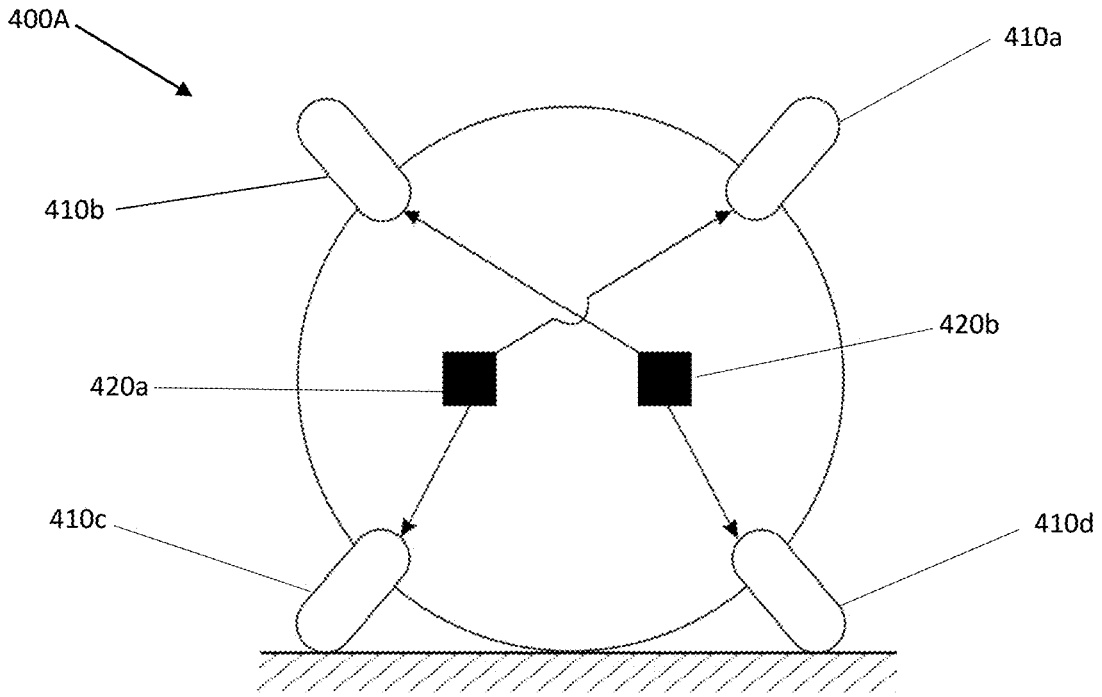
Figure 4a (iii)
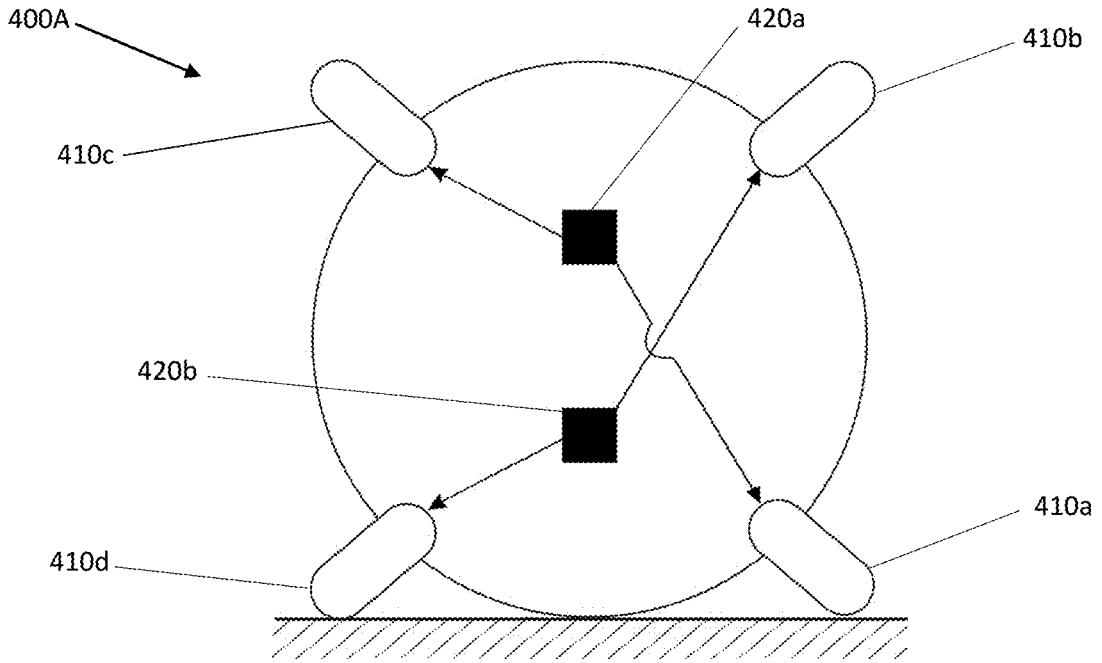
Figure 4a (iv)

TOY VEHICLE AND TRACK SYSTEM THEREFOR

CROSS-REFERENCE TO RELATED APPLICATIONS

This application is a continuation-in-part of U.S. patent application Ser. No. 16/329,732, filed Feb. 28, 2019 and titled "Toy Vehicle and Track System Therefor", the disclosure of which is incorporated herein by reference in its entirety for all purposes.

TECHNICAL FIELD

The present invention relates to the field of toy vehicles, and more particularly to a toy vehicle and a track system for a toy vehicle.

BACKGROUND OF THE INVENTION

A number of toy vehicles and tracks and track systems thereof for such vehicles exist in the market, for entertainment, including providing a platform including for racing, display, entertainment and the like.

A basic example of such toy vehicles and tracks includes gravity powered vehicles that may run along a track configured to retain the vehicle within the bounds of said track, which may be formed from a plurality of track segments. For such track systems, a degree of flexibility may be provided whereby a user may configure a desired track configuration by joining track segments together end to end. Such a system may include a loop or other non-planar variations to the track.

However, the play or motivation or appeal of the system is limited by the need to ensure sufficient gravity power is maintained to enable the vehicle to pass through the various aspects of the track system in order to reach the end of the track.

Such systems may provide for single vehicle usage or for dual tracks for racing. The toy vehicles typically are toy cars with a set of wheels which interact with a drive surface of a track, and the track may include small side-walls to prevent lateral drift.

Another example of a toy vehicle and track system second type includes those of the traditional "slot car" type. These toy vehicles use a track laid out, generally on a substantially flat surface that typically allows two or more vehicles to run alongside each other in a race. The track may be configured within a finite number of configurations, such as straight sections, curved sections, or figure-eights.

The toy vehicles are typically powered by a current supplied through metal slots or grooves embedded in the track, providing an electrical contact surface which is in contact with an electric motor in the vehicle by way of sliding contact brushes, and the toy vehicles are typically prevented from lateral drift by way of a pin protruding from the underside of the toy vehicle and into a slot in the track, save when excess speed causes a toy vehicle to leave the track, such that each toy vehicle has its own designated track, save for switch-overs whereby toy vehicles may switch tracks and as such, the path and direction of travel is predetermined. Such systems provide significantly more game play and player input in comparison to the first, basic type by way of user operable electric throttle devices which are in electrical communication with the electric contact of the track and hence with a player's toy vehicle, and thereby allows for variation of speed, but not direction. Thus, such a system provides for a competition platform for racing between players. However, disadvantages can occur in that the vehicles may often leave the track unexpectedly and unintentionally, and the arrangement of the track is mostly restricted to a planar surface. Although some rises may be accommodated, these cannot be too significant without the toy vehicle losing traction and most likely dislodging the protruding pin from the track groove and thereby becoming inoperable/undriveable.

Another example of toy vehicles are remote controlled toy vehicles, which may be in numerous forms including in the form of a typical car, and having its own power supply, speed controller and steering mechanism. These are generally intended for use outside of track constraints and although some competitive racing may be done, such toy vehicles are not readily adapted for using in a pre-defined track system.

OBJECT OF THE INVENTION

It is an object of the present invention to provide a toy vehicle and track system therefor, which overcomes or ameliorates at least some of the deficiencies as associated with the prior art.

SUMMARY OF THE INVENTION

The present invention may involve several broad forms. Embodiments of the present invention may include one or any combination of the different broad forms herein described.

In a first aspect, the present invention provides a toy vehicle having a longitudinal central axis aligned in a direction of travel and for travel through a passageway of an elongated tubular track having a non-linear pathway which extends in three dimensions and which at least partly confines said toy vehicle, said toy vehicle comprising a first plurality of translational elements comprising two+2n, wherein n=1 or more, translational elements spaced about the longitudinal central axis of the toy vehicle for engagement with the inner surface of the elongated tubular track; and a second plurality of translational elements comprising two+2m, wherein m=1 or more, translational elements spaced about the longitudinal central axis of the toy vehicle for engagement with the curved inner surface of the elongated tubular track, wherein each of the translational elements of the first plurality of translational elements and each of the translational elements of the second plurality of translation elements are independently moveable in relation to each other and are biased in at least an outward radial direction from the longitudinal central axis of the toy vehicle, and a control system for controlling at least the operable rotational speed of at least two translational elements, wherein said at least two translational elements are drive translational elements; upon the toy vehicle travelling through the passageway of the elongated tubular track the translational elements are urged towards the inner surface of the elongated tubular track and such that at least one of the drive translational elements is urged against and maintained in contact with the inner surface of the elongated tubular track such that the rotation of said at least one of the drive translational elements urges the toy vehicle through the elongated tubular track; wherein upon the toy vehicle travelling through a portion of the passageway of the elongated tubular track having a non-linear pathway, the translational elements move relative to the longitudinal central axis and are urged towards the longitudinal central axis such that the toy vehicle is prevented from impinging upon the inner surface of the elongated tubular track such that said at least one of the drive translational elements is maintained against the inner surface of the elongated tubular track; and wherein upon the toy vehicle exiting the elongated tubular track towards and onto a planar surface and being unconstrained within the elongated tubular track (i) the toy vehicle rotates under effect of gravity about the longitudinal central axis such that said drive translational elements are operably engaged with the planar surface; and (ii) the control system operably controls the rotational speed of said drive translational elements, such that the toy vehicle is drivable, and such that the toy vehicle is steerable on the planar surface by providing differential rotational speeds between the translational elements.

The number of translational elements of the first plurality of translational elements may equal the number of translational elements of the second plurality of translational elements.

Each translational element of the first plurality of translational elements may be collinear with a corresponding translational element of the second plurality of translational elements in the direction of the longitudinal central axis.

The first plurality of translational elements may comprise 4 translational elements, and wherein the second plurality of translational elements may comprise 4 translational elements.

The drive translational elements are translational elements of at least the same plurality of translational element.

The drive translational elements may comprise a first set of drive translational elements and a second set of drive translational elements.

The first set of drive translational elements and a second set of drive translational elements may be of at least a same plurality of translational elements. The first set of drive translational elements and a second set of drive translational elements may be of the same plurality of translational elements, and wherein the drive translational elements of the first set of drive translational and of the second set of drive translational elements are disposed alternately about the longitudinal axis. The drive translational elements of the first set of drive translational may be driven by a first motor and the drive translational elements of the second set of drive translational elements may be driven by a second motor. The first set of drive translational elements and a second set of drive translational elements may be both the first and the second plurality of translational elements. All translational elements of the first and the second plurality of translational elements may be drive translational elements.

The translational elements of the first and the second plurality of translational elements may be drive translational elements and may be equally spaced about the longitudinal axis.

The translational elements may be comprised of two wheels.

In a second aspect, the present invention comprises an elongated tubular track for use in conjunction with the toy vehicle according to the first aspect.

The tubular track system is preferably modular. The tubular track system is preferably a three-dimensional arrangement. The tubular track system is preferably an open system opening to a planar surface, to provide entry of the toy vehicle into the tubular track system from a planar surface and exit from the tubular track system to the planar surface. The tubular track system may further include at least one flared element for entry and for exit of the toy vehicle in relation to the tubular track system, and may further include peripheral containment members, whereby the peripheral containment members define a play area therein and comprises a generally elongated perimeter structure having a concave inner lip portion extending upwardly for containing the toy vehicle within the play area.

BRIEF DESCRIPTION OF THE DRAWINGS

The present invention will become more fully understood from the following detailed description of a preferred but non-limiting embodiment thereof, described in connection with the accompanying drawings, wherein:

FIG. 1*b*(*ii*) shows a sectional view of the toy vehicle of FIG. 1*a* along the line B-B of FIG. 1*c;*

FIG. 1*d*(*i*) shows a schematic side view of a flexural element of the toy vehicle of FIG. 1*b*(*i*) in a first position;

FIG. 1*d*(*ii*) shows a schematic side view of a flexural element of the toy vehicle of FIG. 1*b*(*i*) in a second and deflected position;

FIG. 1*e*(*i*) shows a photographic representation of two planar "H"-shaped housing portions of the toy vehicle of FIGS. 1*a* to 1*c;*

FIG. 1*e*(*ii*) shows a photographic representation of two planar "H"-shaped housing portions of FIG. 1*e*(*i*) in a partially assembled configuration;

FIG. 1*e*(*iii*) shows a photographic representation of two planar "H"-shaped housing portions of FIG. 1*e*(*i*) in a fully assembled configuration;

FIG. 1*e*(*iv*) shows a photographic representation of two planar "H"-shaped housing portions of FIG. 1*e*(*i*) in a fully assembled configuration and including side panels and a nose cone assembly;

FIG. 4*a*(*i*) shows a schematic representation of a first embodiment of a toy vehicle according to the present invention at a first angular rotation;

FIG. 4*a*(*ii*) shows a schematic representation of the embodiment of the toy vehicle of FIG. 4*a*(*i*) at a second angular rotation;

FIG. 4*a*(*iii*) shows a schematic representation of the embodiment of the toy vehicle of FIG. 4*a*(*i*) at a third angular rotation;

FIG. 4*a*(*iv*) shows a schematic representation of the embodiment of the toy vehicle of FIG. 4*a*(*i*) at a fourth angular rotation;

DETAILED DESCRIPTION OF THE PREFERRED EMBODIMENTS

Figure 1A:
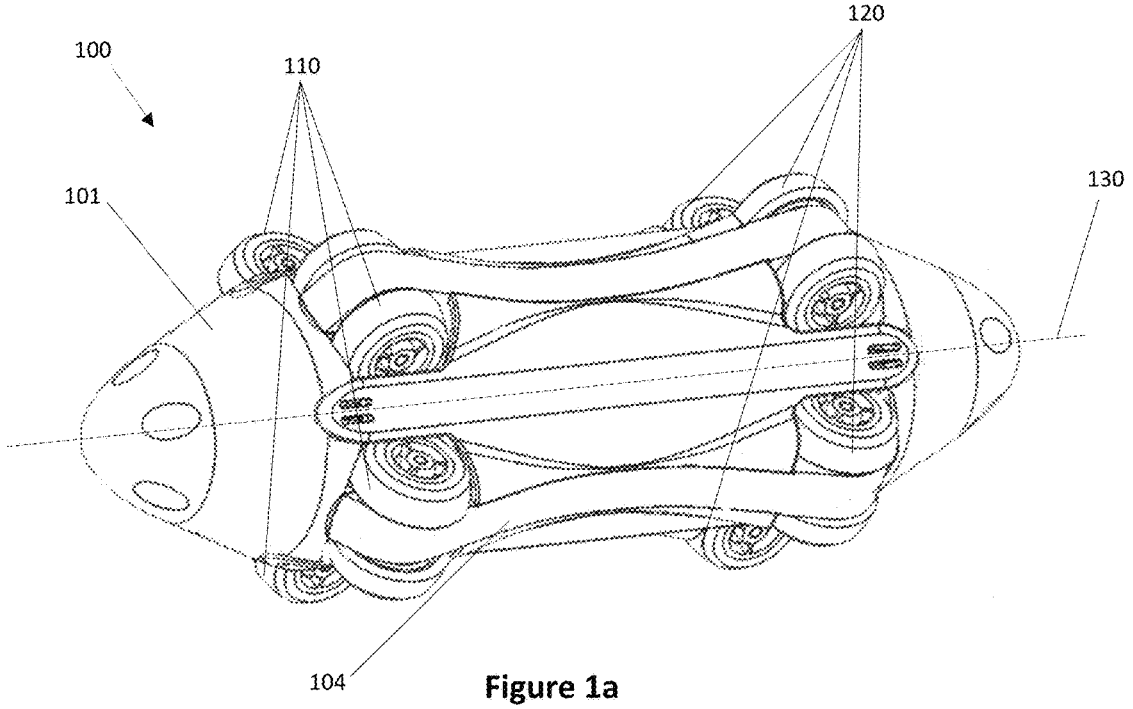
FIG. 1*a* shows a perspective view of a toy vehicle according to the present invention.

The present invention is directed to a toy vehicle and a track system, which provides for enhanced play appeal to users in comparison with those of the prior art.

The present invention provides for a toy vehicle which is capable of being operable both within a tubular track and on a ground surface external of and extraneous or external to such a tubular track.

In particular, embodiments of the present invention provide for a toy vehicle and track system therefor, including an elongated tubular track, wherein the toy vehicle is operable and is capable of at least both of the following:

(i) Traversing substantial bends when travelling through an elongated tubular track without impingement or jamming and without loss of traction;

(ii) Being both drivable and steerable on a planar surface outside of the elongated tubular track upon exiting the elongated tubular track, whereby the planar surface may include undulations or inclinations;

(iii) Irrespective of the orientation of the vehicle when exiting the elongate tubular track, the toy vehicle is immediately both drivable and steerable on a planar surface outside irrespective of which wheels are engaged with the ground surface.

By providing a toy vehicle and track system with the attributes of all (i), (ii) and (iii), the present invention provides a robust, elegant and versatile solution to deficiencies, limitations, complications and inefficiencies of toy vehicles and track systems of the prior art.

Although the term "planar" has been used with reference to the area external of the tubular track, those skilled in the art will understand that the planar surface may include undulations and inclinations, and the term "planar" does not preclude three-dimensional planar surface. As such, the term "planar" in the present invention is not limited or restricted to two-dimensional planar playing areas.

In particular, irrespective of the orientation of the toy vehicle about its longitudinal central axis upon exiting the elongated tubular track and being disposed on the extraneous planar surface outside of the tubular track system, the toy vehicle is both drivable and steerable on such an extraneous planar surface.

Furthermore, in embodiments of the present invention, the toy vehicle is steerable and the tubular track system adapted so as to allow and provide for re-entry of the toy vehicle into the tubular track system.

Still further, the drivability and steerability which is described in detail below, of the toy vehicle is not altered or influenced by the orientation of the vehicle upon it exiting the elongating tubular track, and the novel and innovative arrangement of the translational elements and motors controlling such translational elements.

The present invention importantly provides for controlled steering of a toy vehicle when it exits a tube, irrespective of its orientation and irrespective of which translational elements or wheels are engaged with or are touching the ground surface. As will be explained in further detail, this is conveniently achieved by the implementation of the particulars of the present invention, again which is described and disclosed in detail below and which provides the significant advantage and benefit of providing steerability of the vehicle irrespective of which wheels or translation elements are engaged with the ground surface upon which the toy vehicle travels, thus obviating the necessity for the system to determine which wheels are engaged with the ground surface, such as by use of a sensor system for ascertaining the orientation of the toy vehicle.

Such innovation as provided by the present invention provides a toy vehicle having driveability and steerability with:

(i) superior inherent driveability and steerability without reliance on a sensor system or arrangement or the like;

(ii) increased operable reliability as a result of obviation of a sensor system or the like;

(iii) ease of manufacture and assembly by less electronic componentry during the assembly process (iv) a control system with increased reliability due to less circuitry and input and processing requirements;

(v) reduced manufacturing costs due to decreased componentry;

(vi) reduced unit costs, due to less components as well as lower complexity control system; and (vii) an overall more robust, reliable, simplistic driveability and steerability function and componentry thereof for a toy vehicle.

Furthermore, the present invention provides for a tubular track system having design freedom irrespective of the confines of the area in which the system is to be deployed and utilised, and provides design freedom for a user for configuring the tubular track system layout based on the available play area as well as on user desirability.

The provision of a toy vehicle capable of both travel through both a non-linear elongated tubular track and also capable of travelling on a planar surface external to an elongated tubular track and to have controllability and steerability as provided by the present invention, the dual functionality and whereby the drivability and steerability of the toy vehicle is not altered or influenced by the orientation of the vehicle upon it exiting the elongating tubular track, and the novel and innovative arrangement of the translational elements and motors controlling such translational elements, provides the significant advantage and benefit of obviating the necessity of the requirement of determining which wheels or translational elements are engaged with the ground surface, such as a sensor system for ascertaining the orientation of the toy vehicle or the like, and advantages thereof, which is distinguished from and not provided by other toy vehicles and systems thereof within art and is not suggested, hinted of or anticipated within the prior art.

Further, embodiments of the present invention also provide for enhanced configurability of a tubular track system, with increased versatility and flexibility for utilization of the physical environment in which the tubular track system is deployed and as such, provides for increased creativity in track system configurations. As such, increased interest and play appeal is provided by such versatility.

Accordingly, in addition to a system whose geometry and shape is not limited to a physical environment of deployment, the provision for a multiplicity of configurations also allows users to provide user-defined track layouts, which provides for enhanced user or player interest.

Furthermore, embodiments of the present invention allow for the track system to be configured in a three-dimensional arrangement, thus providing:

(i) enhanced utilisation of the physical play area in which the system is deployed, (ii) enhanced flexibility in track configuration design layout, and (iii) utilisation of a planar surface in addition to the tubular track, for the play domain.

In accordance with the present invention, the toy vehicle comprises a first plurality of translational elements comprising two+2n, wherein n=1 or more, translational elements spaced about the longitudinal central axis of the toy vehicle for engagement with the inner surface of the elongated tubular track; and a second plurality of translational elements comprising two+2m, wherein m=1 or more, translational elements spaced about the longitudinal central axis of the toy vehicle for engagement with the curved inner surface of the elongated tubular track, wherein each of the translational elements of the first plurality of translational elements and each of the translational elements of the second plurality of translation elements are independently moveable in relation to each other and are biased in at least an outward radial direction from the longitudinal central axis of the toy vehicle, and a control system for controlling at least the operable rotational speed of at least two translational elements, wherein said at least two translational elements are drive translational elements.

In use and upon the toy vehicle travelling through a/the passageway of the elongated tubular track, the translational elements are urged towards the inner surface of the elongated tubular track and such that at least one of the drive translational elements is urged against and maintained in contact with the inner surface of the elongated tubular track such that the rotation of said at least one of the drive translational elements urges the toy vehicle through the elongated tubular track; Further, upon the toy vehicle travelling through a portion of the passageway of the elongated tubular track having a non-linear pathway.

The toy vehicle travelling through a portion of the passageway of the elongated tubular track having a non-linear pathway, the translational elements move relative to the longitudinal central axis and are urged towards the longitudinal central axis such that the toy vehicle is prevented from impinging upon the inner surface of the elongated tubular track such that said at least one of the drive translational elements is maintained against the inner surface of the elongated tubular track.

Upon the toy vehicle exiting the elongated tubular track towards a planar surface and being unconstrained within the elongated tubular track:

(i) the toy vehicle rotates under effect of gravity about the longitudinal central axis such that said drive translational elements are operably engaged with the planar surface; and (ii) the control system operably controls the rotational speed of said drive translational elements, such that the toy vehicle is drivable, and such that the toy vehicle is steerable on the planar surface by providing differential rotational speeds between the translational elements.

Figure 1B:
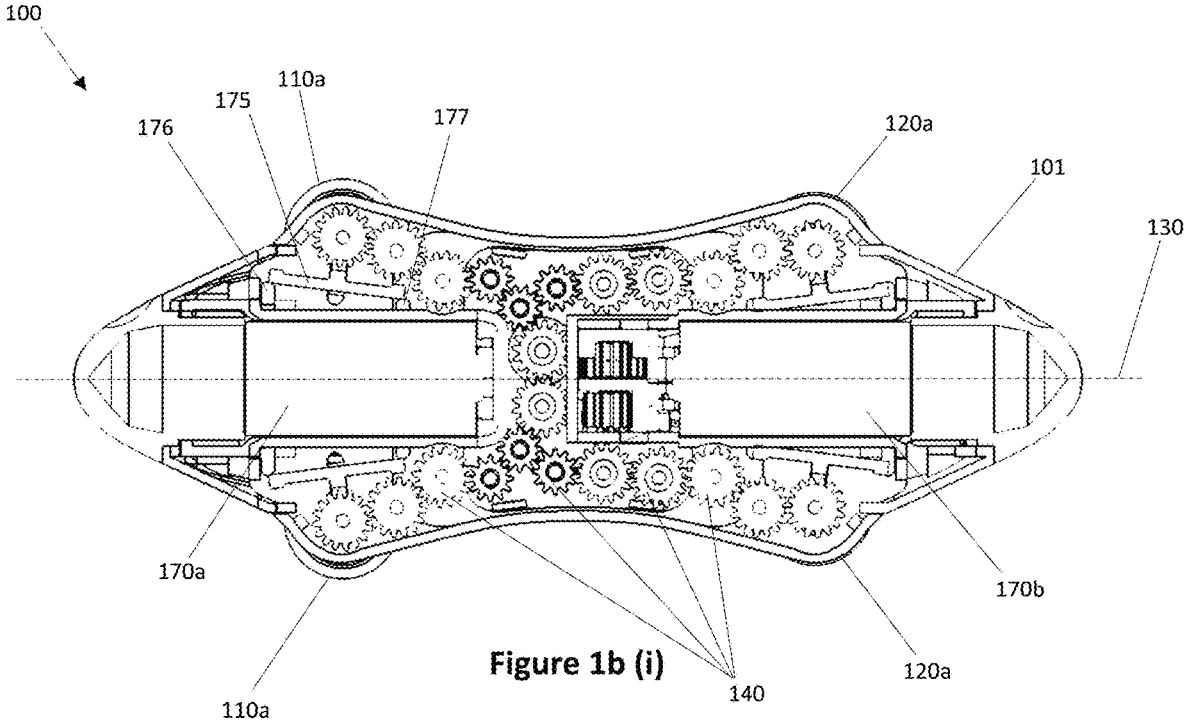
FIG. 1*b*(*i*) shows a sectional view of the toy vehicle of FIG. 1*a* along the line A-A of FIG. 1*c;*
Figure 1C:
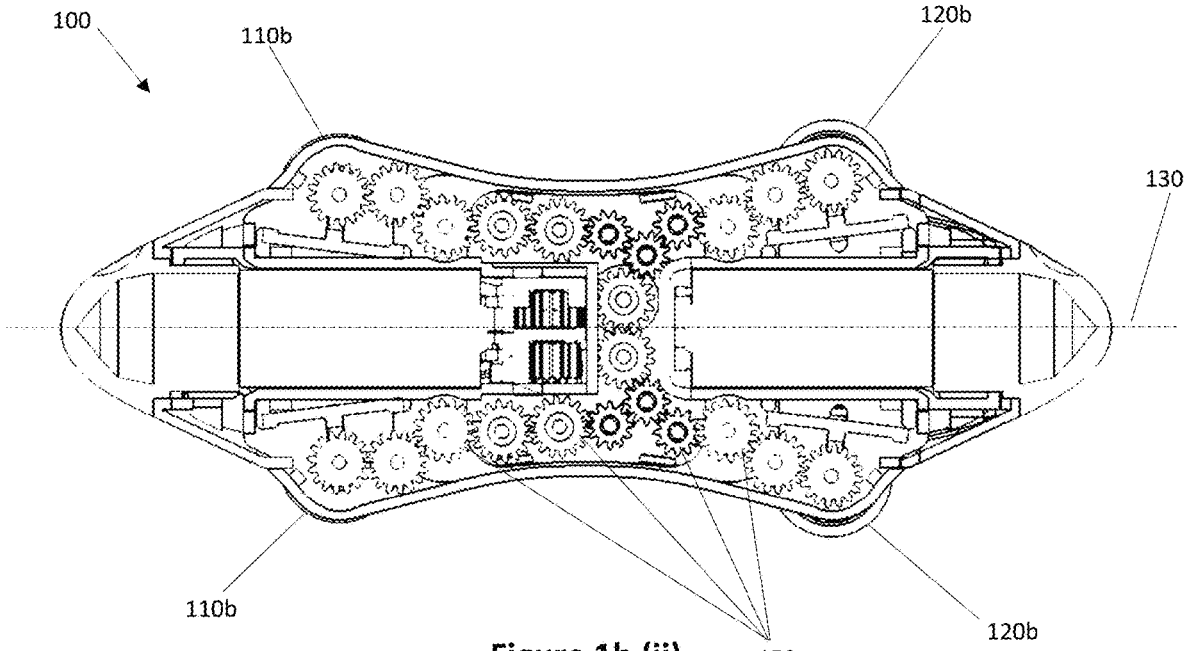
FIG. 1*c* shows an end view of the toy vehicle of FIG. 1*a;*
Figure 1C:
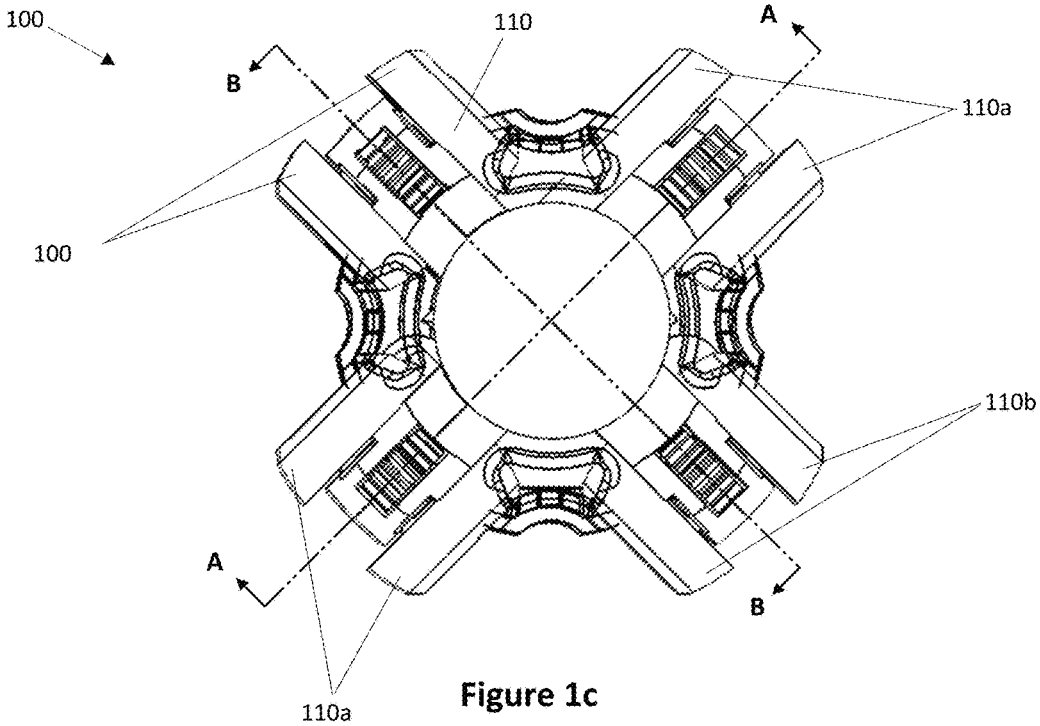

Referring to FIG. 1*a*, 1*b*, 1*c*, there is shown an embodiment of a toy vehicle 100 in accordance with the present invention. In FIG. 1*a*, there is a body member 101 and drive train guards 104 shown which are omitted in FIG. 1*c*, so to allow for ease of explanation.

The toy vehicle 100 has a longitudinal central axis 130 aligned with a direction of travel through a passageway of an elongated tubular track having a non-linear pathway which extends in three dimensions and which at least partly confines said toy vehicle 100. The toy vehicle 100 has a longitudinal central axis 130, and is capable of travelling through a passageway of a tubular track. The tubular track may have different cross sections, and the travel ability of the toy vehicle 100 is not limited to any particular cross-section or geometry. In the present embodiment, the toy vehicle may travel though a tubular track having a circular transverse cross section with a curved inner surface.

The toy vehicle 100 includes a first plurality of translation elements 110 spaced about the longitudinal central axis 130 of the toy vehicle 100 for engagement with the curved inner surface of the track, and further includes a second plurality of translation elements 120 spaced about the longitudinal central axis 130 of the toy vehicle 100 for engagement with the curved inner surface of the track.

In the present embodiment, the first plurality of translational elements 110 comprises 4 translational elements 110, and the second plurality of translational elements comprises 4 translational elements 120. The translational elements are in the present embodiment a pair of wheels.

However, in other and alternate embodiments as will be described in detail below, there may be greater than 4 translational elements for each of the plurality of translational elements, which is an even number of translational elements, such as 6, 8, 10.

In the present embodiment, all of the translational elements are drive translational element which are powered so as to drive the toy vehicle through the passageway of the elongated tubular track although in other and alternate embodiments, all translational elements need not necessarily be drive translational elements.

Each of the translational elements of the first plurality of translational elements 110 and each of the translational elements of the second plurality of translation elements 120 are independently moveable in relation to each other and are biased in at least an outward radial direction from the longitudinal central axis 130 of the toy vehicle 100 such that when urged towards the longitudinal axis 130 they are urged radially outwardly from the longitudinal central axis. This feature is discussed in further detail of the present embodiment with reference to FIG. 1*e* below.

Such movable and radially outwardly biased translation elements 110, 120, provide that upon the toy vehicle 100 travelling through a portion of the track having a non-linear pathway, at least one drive translational element is maintained in contact with the curved inner surface of the elongated tubular track such that motion of the toy vehicle 100 through the elongated tubular track is maintained, and also provides that the toy vehicle 100 importantly is prevented from impinging upon the inner surface of the elongated tubular track.

Thus, the translational elements 110, 120 that are radially moveable independently with respect to each other allows for the toy vehicle 100 to pass through tight bends or turns of the tubular track, and that the toy vehicle 100 does not become impinged upon passing through non-linear portions of the tubular track.

As is shown in FIG. 1*b*(*i*), which is a longitudinal sectional view along line A-A of FIG. 1*c*, translational elements 110*a* of the first plurality of translation elements 110 and translational elements 120*a* of the second plurality of translation elements 120 are driven by a first plurality of gears 140.

Importantly, and now as is shown in FIG. 1*b*(*ii*), which is a longitudinal sectional view along line B-B of FIG. 1*c*, translational elements 110*b* of the first plurality of translation elements 110 and translational elements 120*b* of the second plurality of translation elements 120 are driven by a first plurality of gears 150.

Thus and importantly, diametrically opposed translational elements 110*a*, and diametrically opposed translational elements 120*a* are driven by one of the sets of gears 140. Whereas diametrically opposed translational elements 110*b*, and diametrically opposed translational elements 120*b* are driven by the other of set of gears 150.

As will be understood, adjacent translational elements 110*a* and 110*b*, and 120*a* and 120*b*, are driven by different sets of gears. A first electric motor (not shown) drives the first set of gears 140 and a second electric motor (not shown) drives the second set of gears 150.

Thus, adjacent translational elements 110*a* and 110*b*, and 120*a* and 120*b*, are driven and powered by different motors.

As such, varying the speed of the first motor and the second with respect to each other will result in varying the relative speeds between adjacent translational elements 110*a* and 110*b*, and 120*a* and 120*b*.

Therefore and as will be understood, and as will be discussed in further detail below, this differential relative speed between adjacent translational elements 110*a* and 110*b*, and 120*a* and 120*b* allows for steering of the toy vehicle 100, as there will be two adjacent translational elements 110*a* and 110*b*, and 120*a* and 120*b* on a ground surface when the vehicle is on the ground and not within the passage of an elongated tubular track.

Thus, the novel and inventive concept of having adjacent ground translational elements of a plurality of circumferentially extending translational elements driven independently and which are independently moveable outwardly in a radial direction, allows for a toy vehicle:

(i) for traversing substantial bends when travelling through an elongated tubular track without impingement or jamming and without loss of traction;

(ii) being both drivable and steerable on a planar surface outside of the elongated tubular track upon exiting the elongated tubular track, whereby the planar surface may include undulations or inclinations;

(iii) which, irrespective of the orientation of the vehicle when exiting the elongated tubular track, the toy vehicle is immediately both drivable and steerable on a planar surface outside the tube, irrespective of which wheels are engaged with the planar ground surface.

The toy vehicle 100 includes a power supply, which in the present embodiment is two battery units 170*a*, 170*b*, which power the electric motors.

In order for the translational elements 110 and 120 to be outwardly radially biased, a biasing element is provided, such as helical coil spring, leaf spring, spiral spring, air spring or flexural element or the like.

More particularly and as shown in FIG. 1*d*(*i*) and FIG. 1*d*(*ii*), a flexural element 175, which is also depicted in FIG. 1*b*(*i*), supported by protrusions 176 an 177 which are part of the body member 101 of the toy vehicle.

In the present embodiment, the translational elements 110 and 120 to be outwardly radially biased by way of the flexural element 175 which, by virtue of the elastic properties from which it is formed in conjunction with its geometry and dimensions, when urged radially inwardly by force 178 as shown in FIG. 1*d*(*ii*), a restorative reaction force is induced whereby the translational elements 110 and 120 are urged radially outwardly. Such outward radial force urges the translational elements 110 and 120 against the inner surface of an elongate tubular track when the toy vehicle 100 traverses therethrough, thus maintaining sufficient contact and engagement with the inner surface of the track such that the vehicle has sufficient traction so as to be urged through the track by the electric motors.

Now referring to FIGS. 1*e*(*i*) to 1*e*(*iv*), there is shown and demonstrated the assembly of an embodiment of a toy vehicle 100 according to the present invention.

As shown in FIG. 1*e*(*i*), the toy vehicle 100 is provided as two planar "H"-shaped housing portions 101*a* and 101*b*, which encase the sets of gears 140 and 150 referred to above in reference to FIGS. 1*b*(*i*) and 1*b*(*ii*) respectively, as well as support translational elements 110*a* and 120*a*, and 110*b* and 120*b* respectively.

Now referring to FIG. 1*e*(*ii*), the two planar housing portions 101*a* and 101*b* are urged together at a rotational displacement of 90 degrees with respect to each other about the longitudinal axis of the vehicle which is formed from the two planar housing portions 101*a* and 101*b*. As will be noted, the two planar housing portions 101*a* and 101*b* are slotted together by the complimentary slots disposed between the long members of the "H"-shaped housing portions 101*a* and 101*b*, which, when urged fully together as shown in FIG. 1*e*(*iii*) so as to form the body member 101 of the toy vehicle 100 as shown.

Now referring to FIG. 1*e*(*iv*), side panel 102 and nose cone assembly 103 are affixed to the body member 101 so as to form the completed toy vehicle 100.

Figure 2A:
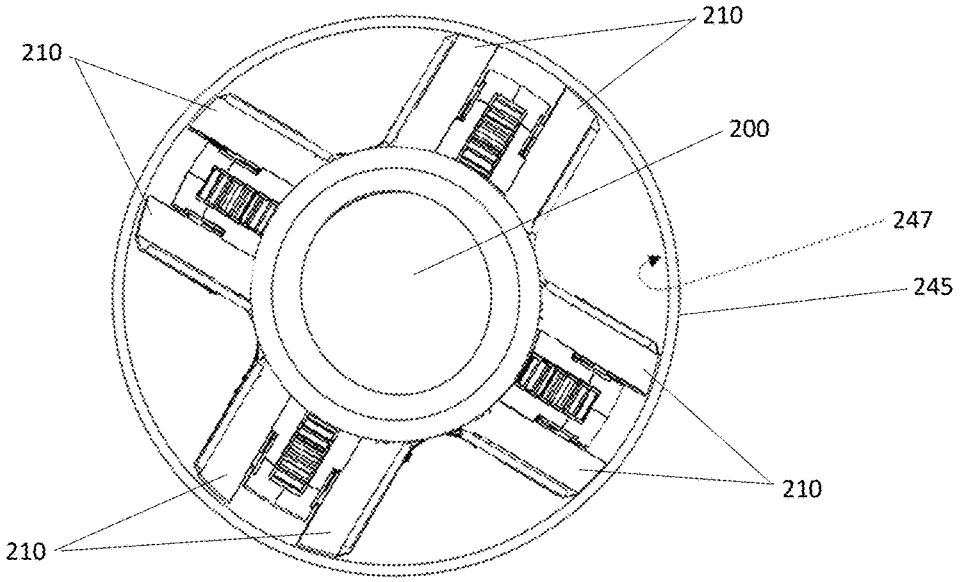
FIG. 2*a* shows an end view of a toy vehicle of FIG. 1*a* inside a tubular track.
Figure 2B:
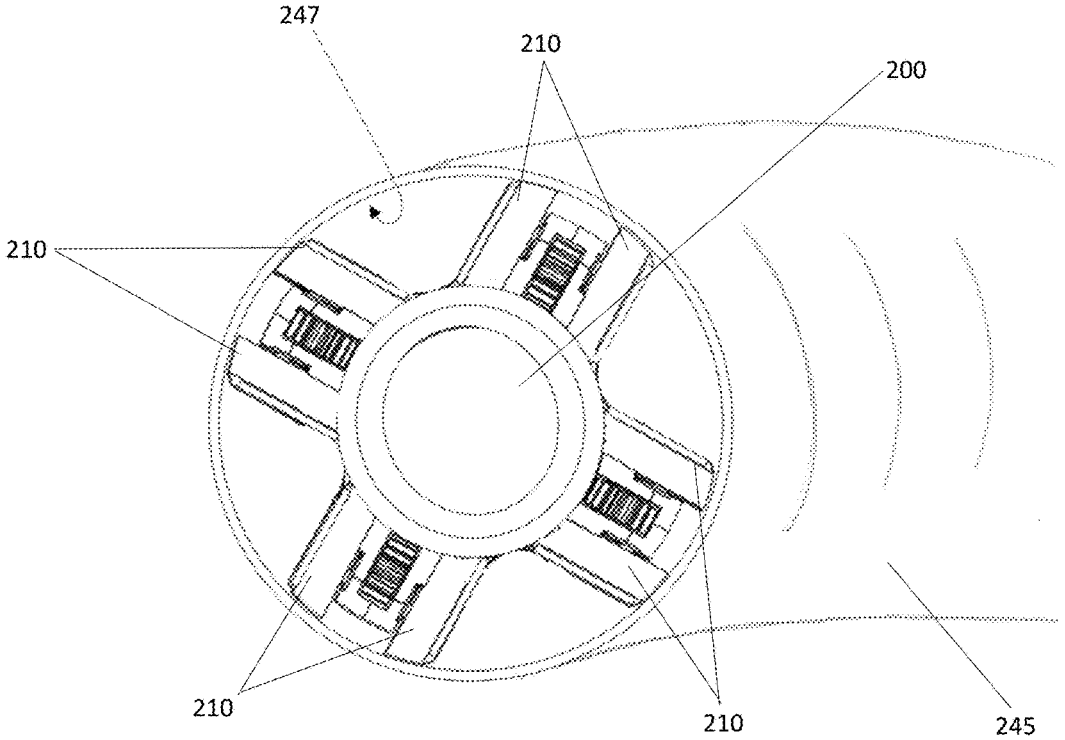
FIG. 2*b* shows a perspective view of the toy vehicle of FIG. 2*a* inside the tubular track.

Referring to FIGS. 2*a* and 2*b*, there is shown an end view of a toy vehicle 200 in a elongate tubular track 245, whereby the first translational elements 210 are urged against the inner wall 247 of the elongate tubular track 245, by way of a biasing element such as helical coil spring, leaf spring, spiral spring, air spring or a flexural element 175 or the like as shown in FIG. 1*d*(*i*) and FIG. 1*d*(*ii*). The biasing elements maintain the translational elements as being urged against the inner wall 247 of the elongate tubular track 245 so as to maintain traction as the toy vehicle 200 traverses through the elongate tubular track 245 in a manner as describe above.

Figure 3A:
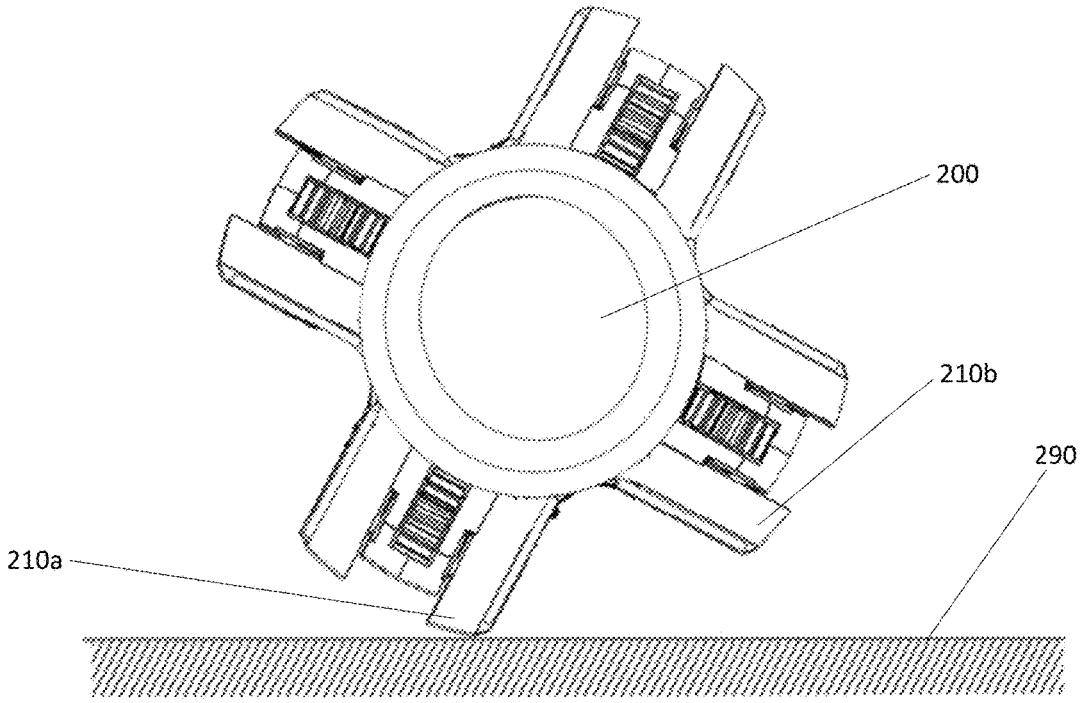
FIG. 3*a* shows an end view of a toy vehicle of FIGS. 2*a* and 2*b* having exited the tubular track and partially engaged with a ground surface.
Figure 3B:
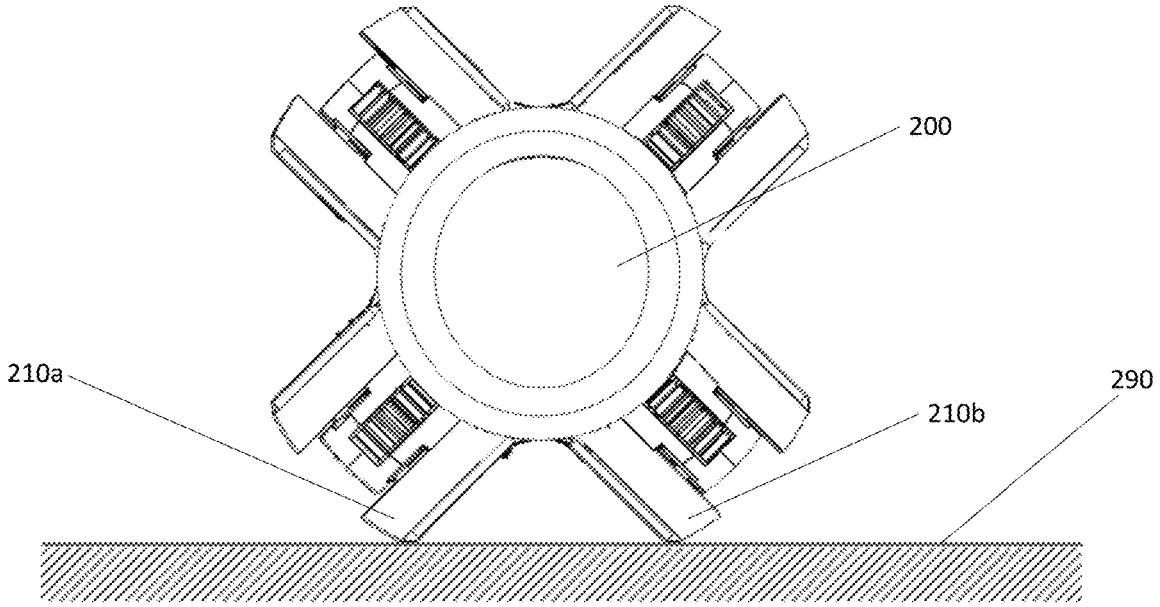
FIG. 3*b* shows an end view of the toy vehicle of FIGS. 2*a*, 2*b* and 3*a* having exited the tubular track and fully engaged with the ground surface.

Now referring to FIG. 3*a* and FIG. 3*b*, as the toy vehicle 200 exits the elongate tubular track 245, a first translational element 210*a* is initially engaged with adjacent ground surface 290.

Under the effect of gravity, and as shown specifically in FIG. 3*b*, the toy vehicle 200 rotates about its longitudinal axis which, although not shown, will be understood to be an axis which extends out of the page, such that translational element 210*b* also engages with adjacent ground surface 290.

As will be understood and is apparent from the above description and disclosure of the present invention, the toy vehicle 200 is now positioned to be both drivable and also steerable on the adjacent ground surface 290.

As can be seen and as will be understood, irrespective of the orientation of the toy vehicle 200 when exiting the elongated tubular track 245, the toy vehicle 200 is immediately both drivable and steerable on a planar surface outside the tube, irrespective of which translational elements are engaged with the planar ground surface. As described above, as adjacent translational elements are driven by different motors independently, which provides for such steering irrespective of the orientation of the toy vehicle, thus again obviating the necessity for determining which translational elements or wheels are engaged with the ground surface, or the orientation of the vehicle about its longitudinal axis. The advantages and benefits of the present invention embodying such capabilities are discussed above.

Referring to FIGS. 4*a*(*i*) to 4*a*(*iv*), there is shown a schematic representation of a front view of a toy vehicle 400A in accordance with the present invention, with characteristics and features embodied therein as described with reference to the toy vehicles above.

The toy vehicle 400A include a first set of translational elements 410*a*, 410*b*, 410*c*, 410*d*, which may be wheels for example, which in the present embodiment are equally spaced about a circumference about the end-on longitudinal central axis extending out of the page. However, in other or alternate embodiments, the translational elements 410*a*, 410*b*, 410*c*, 410*d* need not necessarily be equally or evenly spaced apart.

As is shown a first motor and drive assembly represented schematically by 420*a*, powers and drives translational elements 410*a* and 410*c*, and a second motor and drive assembly represented schematically by 420*b*, powers and drives translational elements 410*b* and 410*d*.

As will be readily observed and in accordance with the invention, the translational elements 410*a* and 410*b* engaged with the ground surface are powered by different motor and drive assemblies 420*a* and 420*b* and as such and as described above, this provides for both driving and steering of the vehicle 400A on the ground surface whereby the steering is effected by differential rotational speeds between the translational elements 410*a* and 410*b*.

If the vehicle is oriented such as in FIG. 4*a*(*ii*) whereby translational elements 410*b* and 410*c* are engaged with the ground surface, again driving and steering may achieved by variation in the rotational speed of the translational elements which can be readily effected by controlling the speeds of motor and drive assemblies 420*a* and 420*b*, as motor and drive assembly 420*a* controls translational element 410*c* and motor and drive assembly 420*b* controls translational element 420*b*. As will be understood, although translational elements 410*a* and 410*d* are not engaged with the ground surface, they will still rotate and the same speed as translational elements 410*c* and 410*b* respectively.

Now referring to FIG. 4*a*(*iii*), when translational elements 410*c* and 410*d* are engaged with the ground surface, as they are controlled by motor and drive assemblies 420*a* and 420*b* respectively, again steering can be effected by differential rotational speeds between the translational elements 410*c* and 410*d*.

Similarly as shown in FIG. 4*a*(*iv*) when translational elements 410*d* and 410*a* are engaged with the ground surface, as they are controlled by motor and drive assemblies 420*b* and 420*a* respectively, again steering can be effected by differential rotational speeds between the translational elements 410*d* and 410*a*.

Figure 4B:
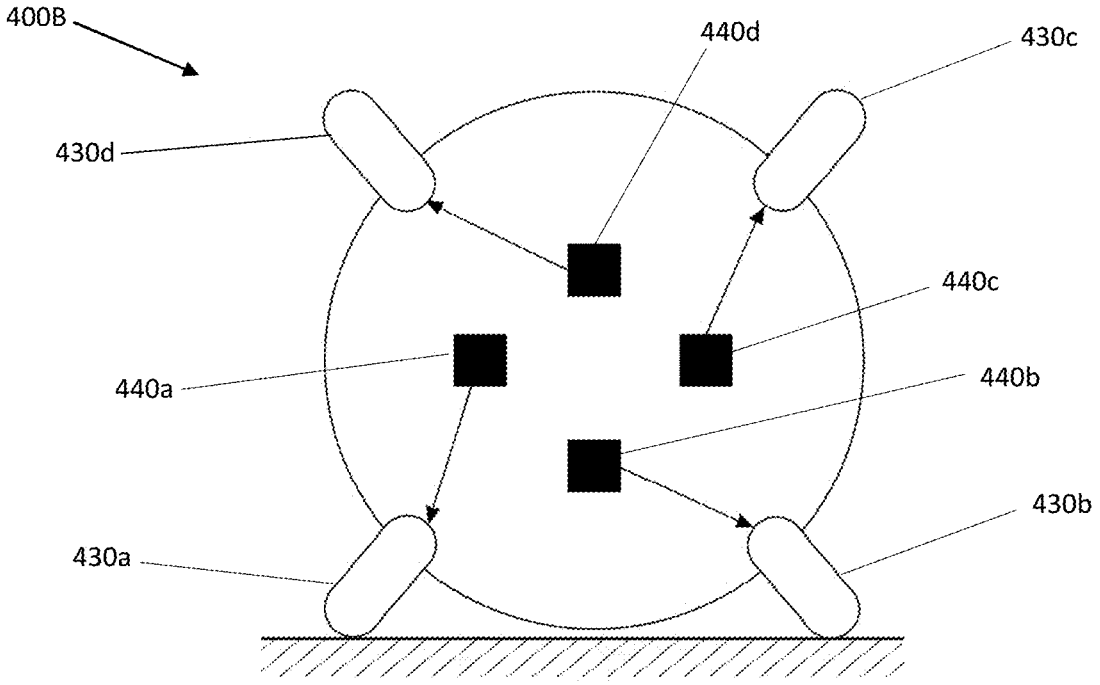
FIG. 4*b* shows a schematic representation of a second embodiment of a toy vehicle according to the present invention.

Now referring to FIG. 4*b*, which is of a similar arrangement to the embodiment of FIGS. 4*a*(*i*) to 4*a*(*iv*), however each translational element 430*a*, 430*b*, 430*c* and 430*d* are each independently driven and controlled by motor and drive assemblies 440*a*, 440*b*, 440*c* and 440*d* respectively.

Again, steering can be effected in the same manner as described as above, as any adjacent translation elements engaged with the ground surface are driven and controlled by a different motor and control assembly.

However, for ease of control, as will be understood when the toy vehicle 400B exits a tubular track, a user cannot readily control which translational elements will be engaged with the ground surface and are thus required for driving and steering and as such, each motor and drive assemblies powering a respective translational element is operatively controlled in unison with motor and drive assemblies powering each alternate translational element.

Accordingly, motor and drive assemblies 440*a* and 440*c* are controlled in unison with each other, while motor and drive assemblies 440*b* and 440*d* are controlled in unison with each other.

As such and irrespective of the orientation of the vehicle 400B and which translational elements are engaged with the ground surface, there are only two groups of translational elements, and each group is independently controllable from the other.

Accordingly, as can be appreciated, the present invention can provide for steering by differential rotational speeds between the translational elements:

(i) when there is an even number of translational elements, whereby there must be at least four translational elements to provide for ground engagement when the vehicle exits the tubular track and rotates about its longitudinal axis such that two translational elements engage with a ground surface, (ii) when adjacent translation elements are driven by different motor and drive assemblies, and (iii) there are only two groups of translational elements, and each group is independently controllable from the other.

Figure 5A:
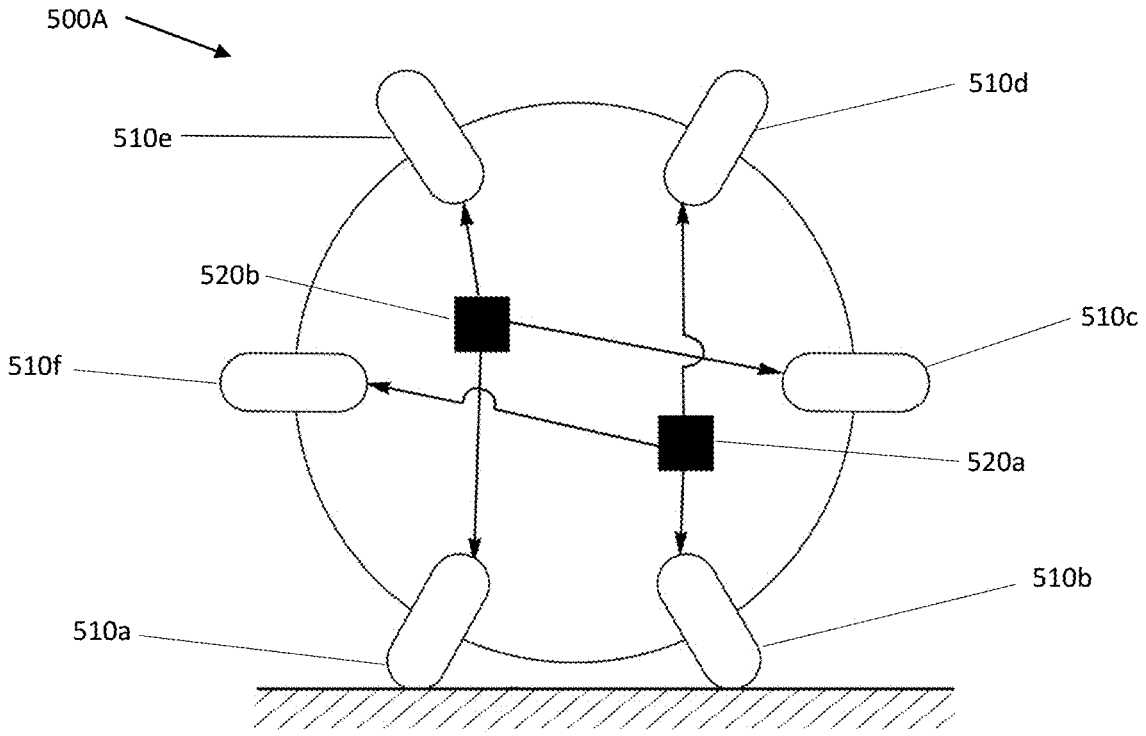
FIG. 5*a* shows a schematic representation of a third embodiment of a toy vehicle according to the present invention.

Referring to FIG. 5*a*, the toy vehicle 500A has six translation elements 510*a*, 510*b*, 510*c*, 510*d*, 510*e* and 510*f*. Translation elements 510*a*, 510*c*, 510*e* are driven and controlled by motor and drive assembly 520*b*, and translation elements 510*b*, 510*d*, 510*f* are driven and controlled by motor and drive assembly 520*a*.

Accordingly and as will understood, irrespective of the orientation of the toy vehicle 500A and which two translational elements are engaged with the ground surface, one ground engaging translational element will be driven and controlled by motor and drive assembly 520*a* and the other adjacent ground surface engaging translational element will be driven and controlled by motor and drive assembly 520*b*, thus providing for steerability by differential rotational speed of ground engaging translational elements as described above and in accordance with the present invention.

Figure 5B:
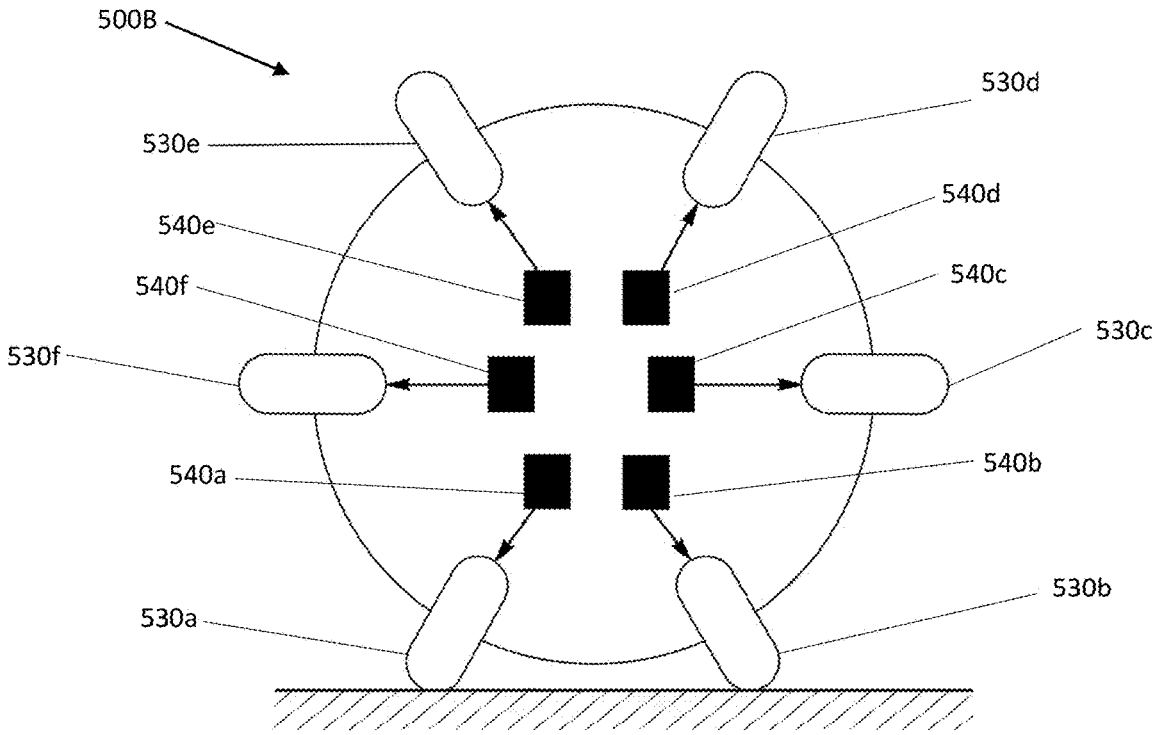
FIG. 5*b* shows a schematic representation of a fourth embodiment of a toy vehicle according to the present invention.

Referring to FIG. 5*b*, the toy vehicle 500B has six translation elements 530*a*, 530*b*, 530*c*, 530*d*, 530*e* and 530*f* are driven and controlled by motor and drive assemblies 540*a*, 540*b*, 540*c*, 540*d*, 540*e* and 540*f* respectively.

Motor and drive assemblies 540*a*, 540*c* and 540*e* are controlled collectively together in unison, and motor and drive assemblies 540*b*, 540*d* and 540*f* and 540*f* are controlled collectively together in unison and such that there are only two groups of translational elements, and each group is independently controllable from the other.

Accordingly and as will understood, irrespective of the orientation of the toy vehicle 500B and which two translational elements are engaged with the ground surface, one ground engaging translational element will be driven and controlled by motor and drive assembly group 540*a*, 540*c* and 540*e*, and the other adjacent ground surface engaging translational element will be driven and controlled by motor and drive assembly group 540*b*, 540*d* and 540*d*, thus providing for steerability by differential rotational speed of ground engaging translational elements as described above and in accordance with the present invention.

Figure 6A:
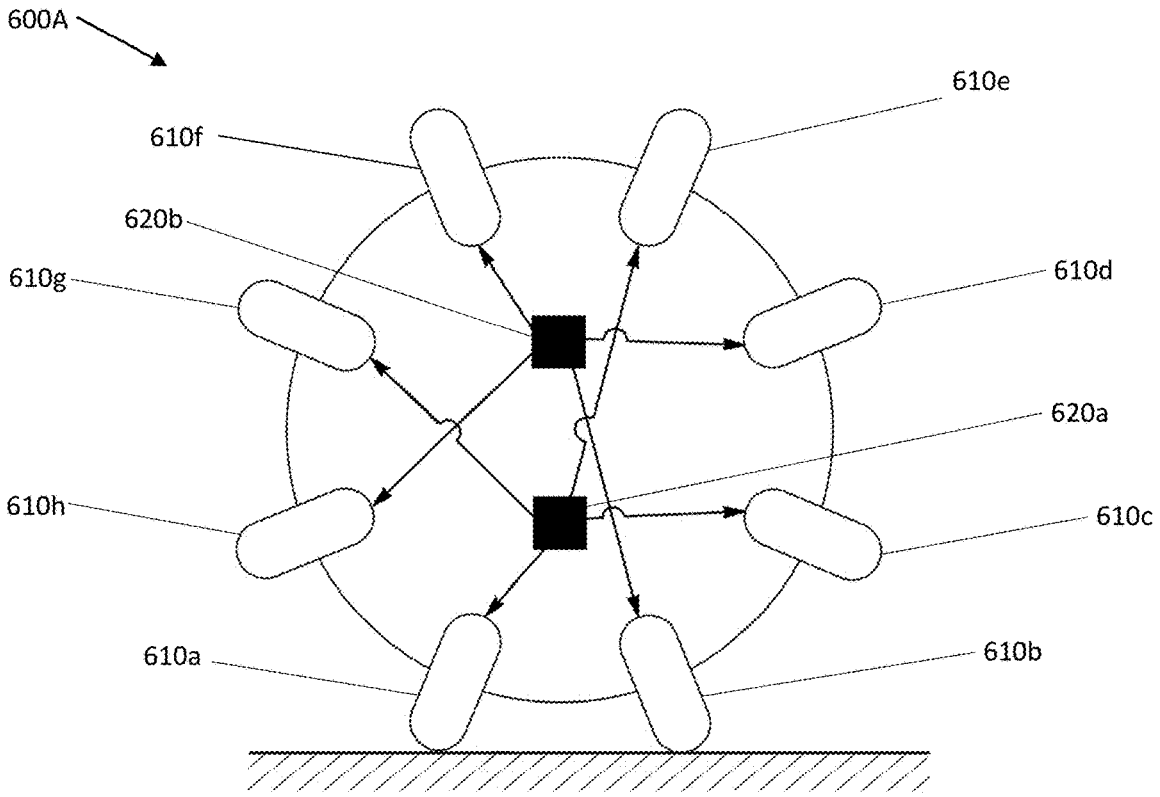
FIG. 6*a* shows a schematic representation of a fifth embodiment of a toy vehicle according to the present invention.

Referring to FIG. 6*a*, the toy vehicle 600A has eight translation elements 610*a*, 610*b*, 610*c*, 610*d*, 610*e*, 610*f*, 610*g* and 610*h*. Translation elements 610*a*, 610*c*, 610*e* and 610*g* are driven and controlled by motor and drive assembly 620*a*, and translation elements 610*b*, 610*d*, 610*f* and 610*h* are driven and controlled by motor and drive assembly 620*b*.

Accordingly and as will understood, irrespective of the orientation of the toy vehicle 600A and which two translational elements are engaged with the ground surface, one ground engaging translational element will be driven and controlled by motor and drive assembly 620*a* and the other adjacent ground surface engaging translational element will be driven and controlled by motor and drive assembly 620*b*, thus providing for steerability by differential rotational speed of ground engaging translational elements as described above and in accordance with the present invention.

Figure 6B:
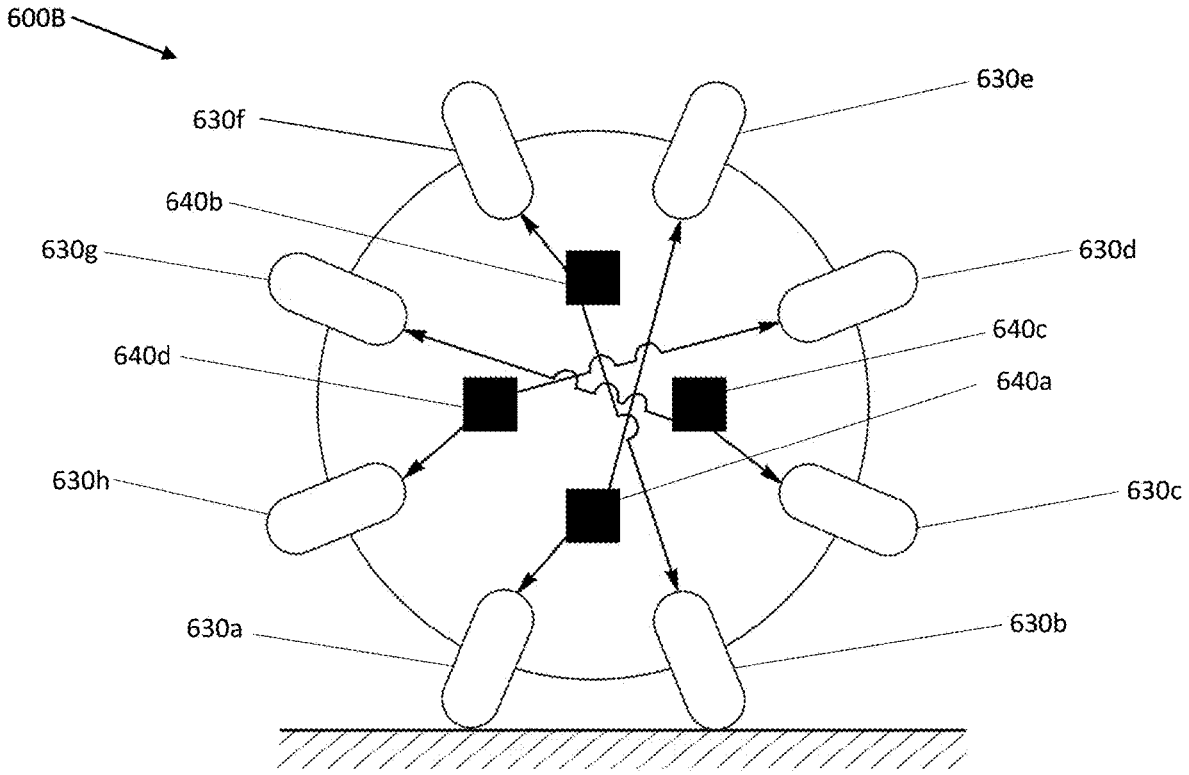
FIG. 6*b* shows a schematic representation of a sixth embodiment of a toy vehicle according to the present invention.

Referring to FIG. 6*b*, the toy vehicle 600B has eight translation elements 630*a*, 630*b*, 630*c*, 630*d*, 630*e*, 630*f*, 630*g* and 630*h*, whereby translation elements 630*a*, 630*c*, 630*e* and 630*g* are driven and controlled by motor and drive assemblies 640*a* and 640*c*, and whereby translation elements 630*b*, 630*d*, 630*f* and 630*h* are driven and controlled by motor and drive assemblies 640*b* and 640*d*.

Motor and drive assemblies 640*a* and 640*c* are controlled collectively together in unison, and motor and drive assemblies 640*b* and 640*d* are controlled collectively together in unison and such that there are only two groups of translational elements, and each group is independently controllable from the other.

Accordingly and as will understood, irrespective of the orientation of the toy vehicle 600B and which two translational elements are engaged with the ground surface, one ground engaging translational element will be driven and controlled by motor and drive assembly group 640*a* and 640*c*, and the other adjacent ground surface engaging translational element will be driven and controlled by motor and drive assembly group 640*b* and 640*d*, thus providing for steerability by differential rotational speed of ground engaging translational elements as described above and in accordance with the present invention.

Referring to FIGS. 4*a*(*i*) to 6*b* collectively, only a first plurality of translational elements at one end of the toy vehicle is shown which would be disposed towards a first end of the vehicle, as the figures are end-on. As will be understood, a second corresponding plurality of translational elements towards the second end of the vehicle would be present.

In embodiments, the second corresponding plurality of translational elements may be passive elements, and not be powered at all.

Alternatively, and as described in reference to FIGS. 1*a* to 1*c*, the corresponding front and rear translational elements are powered, and may be powered by the same electric motor.

Also, as will be understood, in other or alternate embodiments, and by way of example, alternate translational elements of the first plurality of translational elements may be powered, by the same of different motors, and translational elements between those powered translational elements may not be powered. And, for the second plurality of translational elements, alternate translational elements may be powered and translational elements between those powered translational elements may not be powered, and the powered translational elements of the second plurality of translational elements are offset and not aligned with the powered translational elements of the first plurality of translational elements As such, upon the toy vehicle being engaged with the ground surface, for example a left front translational element is powered and a right rear translational element is powered, and by providing differential speed between the two then steering may be effected.

In other and alternate embodiments:

(i) there need not necessarily be the same number of translational elements in the first and second plurality of translational elements, (ii) the translational elements need not necessarily be evenly spaced about the central axis;

(iii) the translational elements of the first plurality of translational elements and then translational elements of the second plurality of translational elements need not necessarily be aligned in the longitudinal direction and; and (iv) although it is preferable that translational elements on opposite sides of the longitudinal axis be powered so as to provide for steering via differential rotational speed, in some embodiments the separately powered translational elements which are engaged with the ground surface may be on the same side of the central longitudinal axis yet at different lateral offsets.

Whilst there are numerous combinations of translational elements and arrangements thereof falling within the scope and definition of the present invention, at a minimum upon the toy vehicle exiting a tubular track, irrespective of the orientation of the vehicle and irrespective of which translational elements may be engaged with the ground surface, provided at least one powered translational element powered by a first motor and drive assembly is operatively engaged with the ground surface and at least one powered translational element by a first motor and drive assembly is operatively engaged with the ground surface, the toy vehicle is drivable and steerable on the ground surface by way of differential speed of those two powered translational elements.

As will be also understood by those skilled in the art, such an arrangement also inherently allows the toy vehicle to be driven through an elongated tubular track having a non-linear pathway which extends in three dimensions, in accordance with the present invention.

Figure 7:
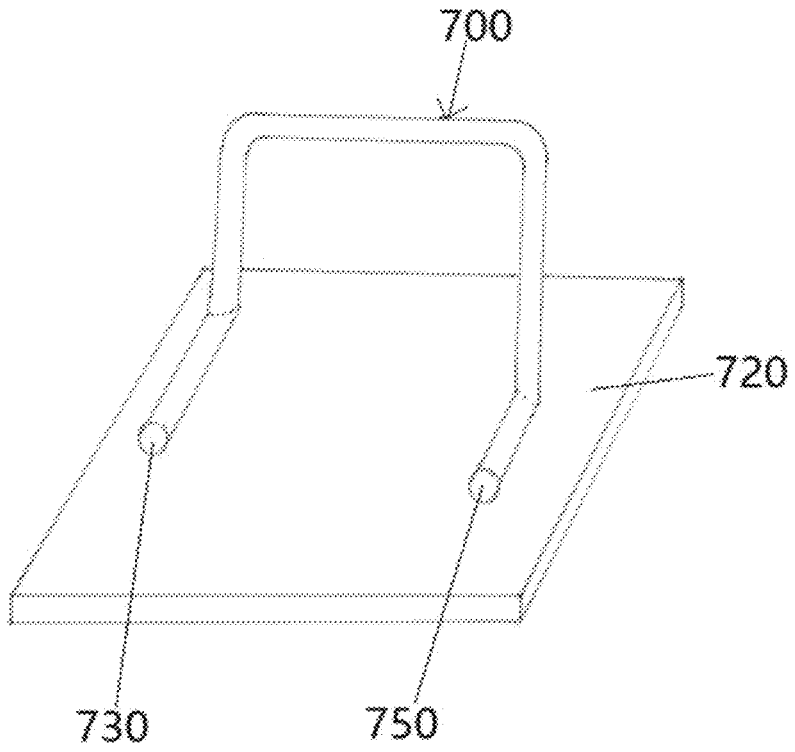
FIG. 7 shows a further configuration of a tubular track for use with a toy vehicle in accordance with the present invention.

Referring to FIG. 7, there is shown a configuration of a tubular track 700 for use with a toy vehicle in accordance with the present invention. As shown, the tubular track 700 is placed on a planar surface 720 defining an open and extraneous play area, and has openings 730 and 750 through which a toy vehicle may exit or enter the tubular track 700.

Figure 8:
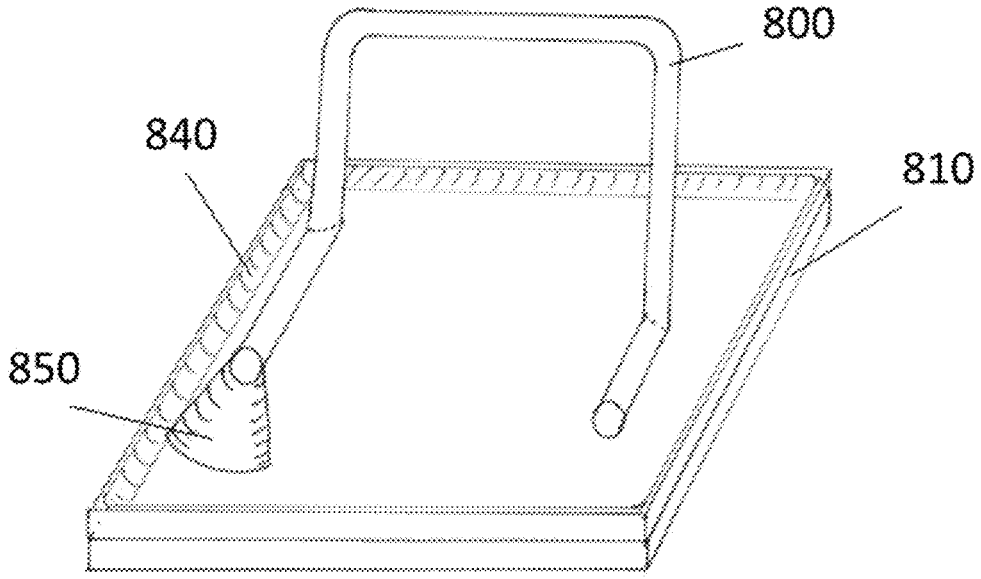
FIG. 8 shows a further configuration of a tubular track system for use with a toy vehicle in accordance with the present invention having a flared entry element having concave inner lips and guidance grooves and protrusions and peripheral containment members with concave inner lips enclosing an open, extraneous play area.

Referring to FIG. 8, there is shown a further configuration of a tubular track 800 on a planar surface 810 for use with a toy vehicle in accordance with the present invention having a flared entry element as an entry funnel 850 and peripheral skirt 840 which defines a play area within a perimetered area as prescribed by the peripheral skirt 840.

The entry funnel 850 provides assistance for toy vehicles to enter the tubular track 800, and the peripheral skirt 840 includes a concave curved and upwardly extending surface upon which a toy vehicle may at least partially travel there along, so as to be retained within a prescribed play area. The play area allows for two or more toy vehicles which are individually controllable to be used at the same time so as to provide a competitive racing environment.

As will be appreciated by those skilled in the art, the entry funnel 850 may be formed integrally with the peripheral skirt 840 without departing from the scope of the invention.

Figure 9:
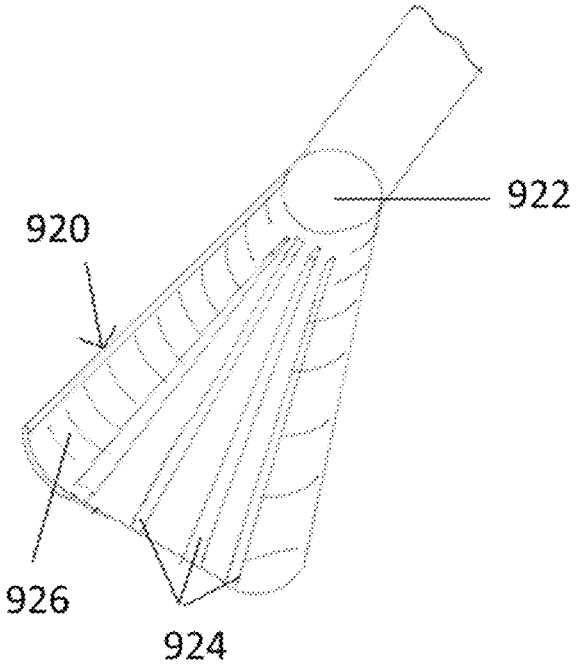
FIG. 9 shows the flared entry element of FIG. 8 and with concave inner lips and guidance grooves and protrusions of FIG. 8.

Referring to FIG. 9, a detailed view of an embodiment of the entry funnel 920 of FIG. 8 is shown, whereby the entry funnel includes an entry aperture 922 through which a toy vehicle may pass so as to enter the tubular track, and includes a plurality of guidance portions 924 converging towards the tubular track to guide the toy vehicle towards the tubular track from the planar surface or play area, wherein the guidance portions are a series of converging grooves and/or protrusions. The entry funnel 920 includes an upwardly extending curved lip 926 so as to further guide the toy vehicle towards the entry aperture 922.

Figure 10A:
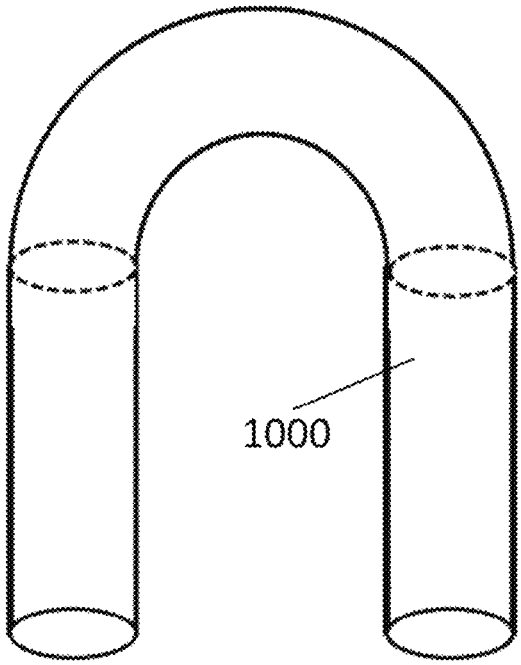
FIG. 10*a* shows a first example of a tubular track element for the tubular track in accordance with the present invention.
Figure 10B:
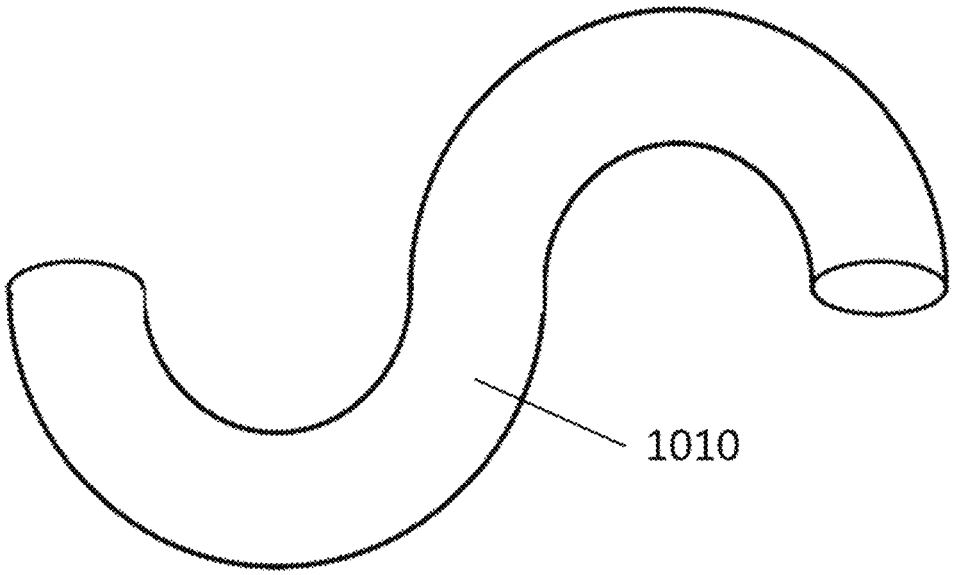
FIG. 10*b* shows a second example of a tubular track element for the tubular track in accordance with the present invention.
Figure 10C:
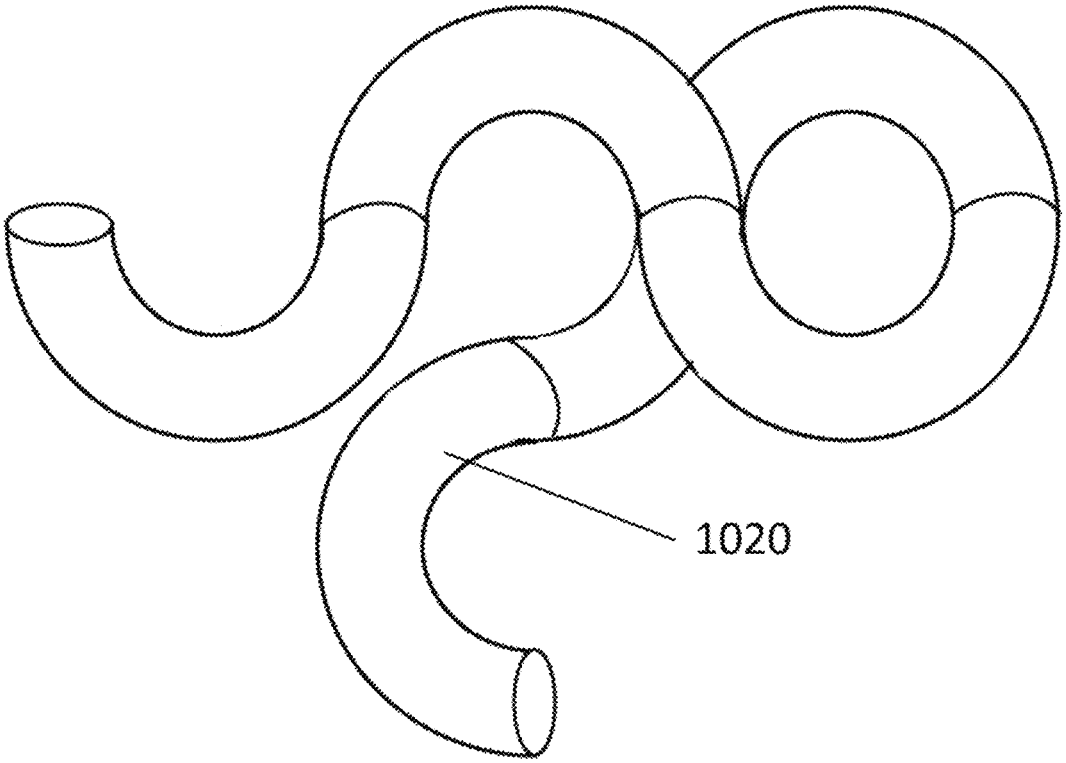
FIG. 10*c* shows a third example of a tubular track element for the tubular track in accordance with the present invention.

As will be appreciated, the tubular track may be modular and configurable by a user, and various tubular elements may be incorporated, such as a U-bend as shown in FIG. 10*a*, and S-bend as shown in FIG. 10*b* or a loop element as shown in FIG. 10*c*. Other elements may also be utilised and incorporated, such as bends, u-bends, corkscrew elements and the like.

Figure 11:
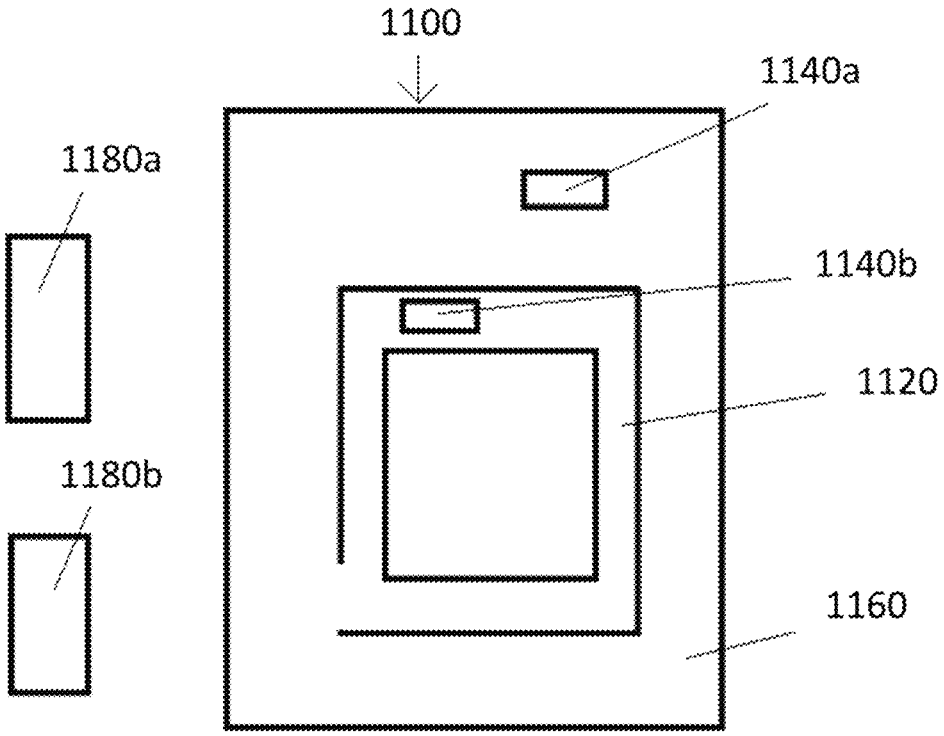
FIG. 11 shows a schematic representation of a toy vehicle and tubular track system according to the present invention.

Referring to FIG. 11, there is shown a schematic representation of an example of a toy vehicle and tubular track system 1100 according to the present invention. The system 1100 includes a tubular track 1120 and a play area 1160 similar as described above in reference to FIG. 8. In the present example, two toy vehicles 1140*a* and 1140*b* are provided, each having respective remote controls 1180*a* and 1180*b* for controlling the toy vehicles 1140*a* and 1140*b*, so as to be able to traverse the play area 1160 and exit and enter the tubular track 1120As with other embodiments, the tubular track 1120 may be formed of individual tubular elements, such that the tubular track may be assembled and configured by a user.

Figure 12:
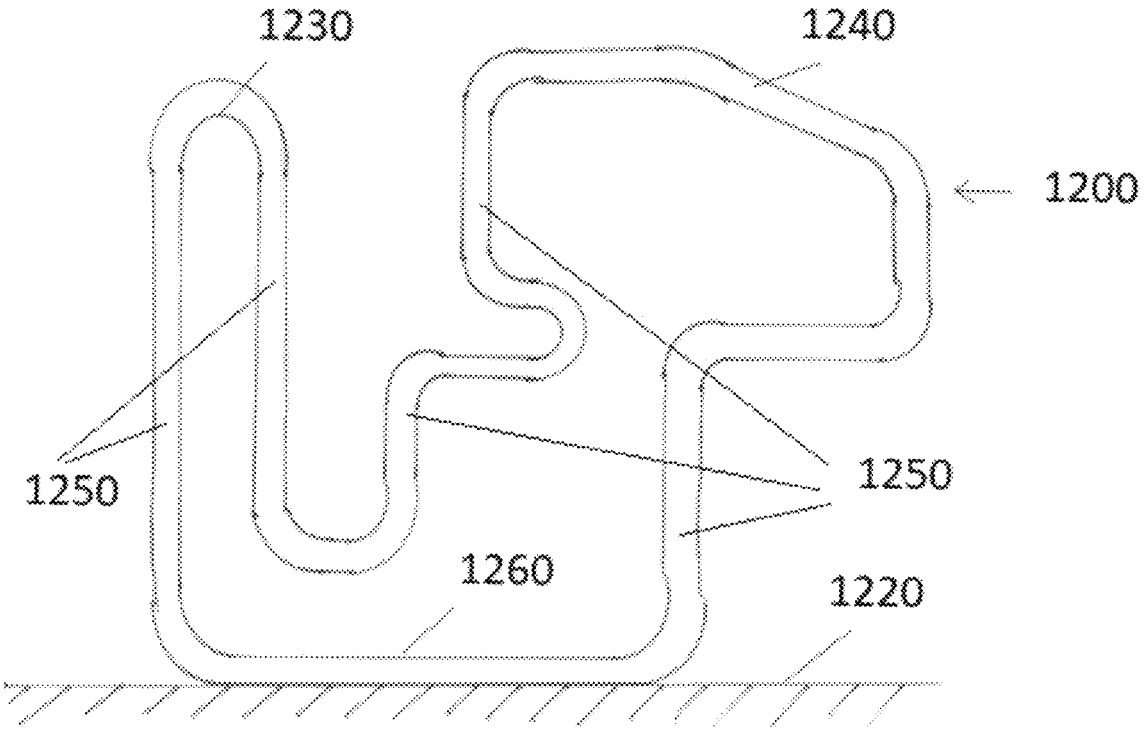
FIG. 12 shows a fourth example of a tubular track system accordance with the present invention.

FIG. 12 shows a tubular track 1200 for use with a toy vehicle in accordance with the present invention. The tubular track 1200 sits on a ground surface 1220 and is depicted as extending in a vertical direction. The tubular track includes a plurality of sections which include U-bend sections 1230, inclined sections 1240, straight vertical sections 1250 and straight, horizontal sections 1260.

In embodiments of the invention, the tubular track 1200 is modular and can be configured to a user-preferred arrangement. The tubular track 1200 may extend in three dimensions and may be inclined at various angles and inclinations.

Figure 13:
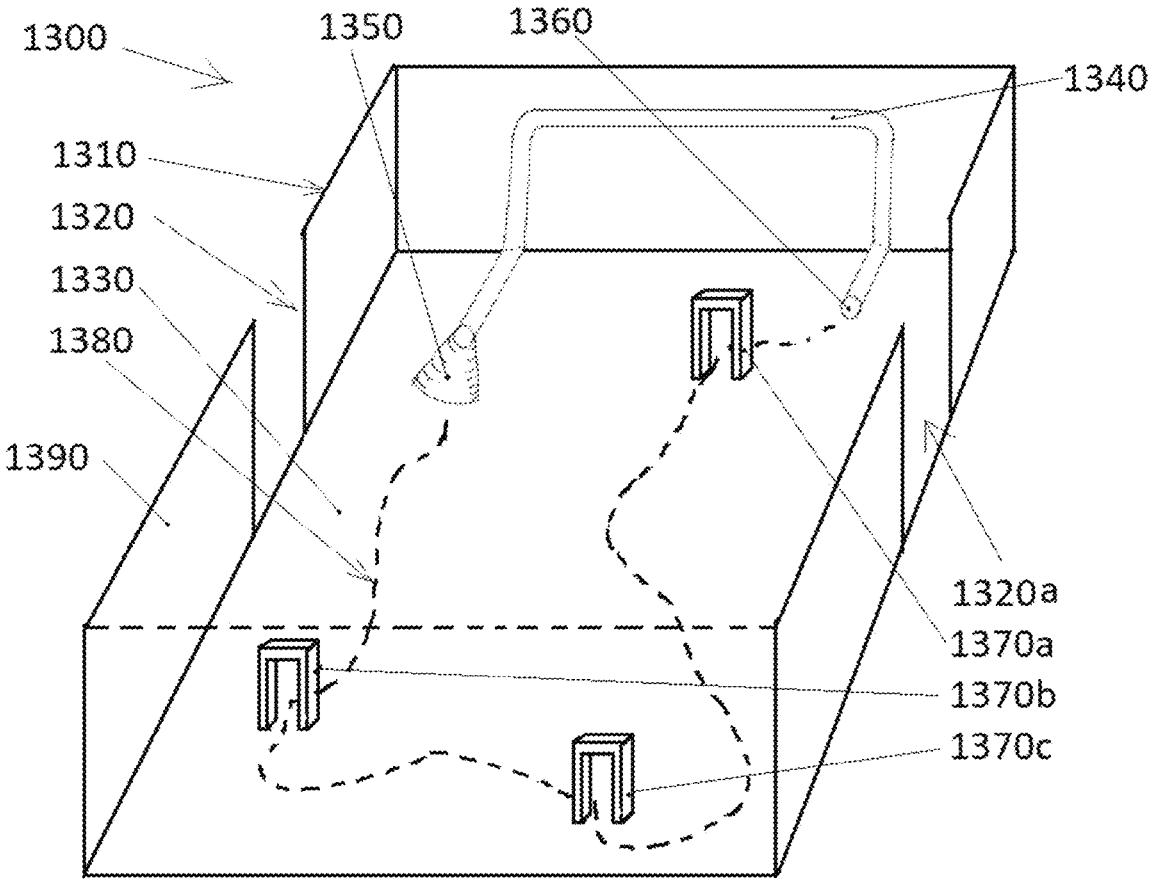
FIG. 13 shows a further example of a tubular track system in accordance with the present invention.

Referring to FIG. 13, there is shown a schematic representation of an example of a track system 1300 according to the present invention. The system 1300 includes a tubular track 1340 which include an exit end 1360 for a toy vehicle of the present invention to exit therefrom, and an entry funnel 1350 for the toy vehicle to enter the tubular track 1360. The system 1300 further includes a plurality of track extension elements 1370*a*, 1370*b* and 1370*c*.

The system is deployed in a zone 1310 defied by a vertical perimetrical wall 1390 which defines a play area 1330 as a planar surface. In the present example, the perimetrical wall 1390 has a first aperture 1320 and a second aperture 1320*b* which defines a pathway therebetween. The zone 1310 may be a room, such as a living room, and the first aperture 1320 and the second aperture 1320*b* may be doorways which define a pathway through which a person may walk traverse.

The track extension elements 1370*a*, 1370*b* and 1370*c* are deployed in the zone 1310 and a play pathway extends from the exit end 1360 of the tubular track 1340, through extension element 1370*a*, through extension element 1370*c* and through extension element 1370*b*) back to entry funnel 1350. As such, a toy vehicle may be driven through the track system 1300 which allows for the system 1300 to utilise a large play area within the zone 1310.

Accordingly, the system may be utilised to optimise the area in which it is deployed, in three dimensions, whereby the tubular track 1340 can be configured in an applicable area whereby it does not obstruct the pathway between the apertures 1320 and 1320*a*, whilst further utilizing play area 1330 by virtue of the track extension elements 1370*a*, 1370*b* and 1370*c*, such that a person may walk between apertures 1320 and 1320*a* without being obstructed by any physical elements or components of the system 1300.

As such, the system 1300 provides versatility to use a three dimensional region, for example within a living room, so as to take advantage of both the vertical and horizontal dimensions of the room, whilst maintaining play appeal to users while simultaneously minimising any reduction of utility of the zone 1310 for other people/users of the space. This is in contrast to systems of the prior art, whereby a track requires a relatively large designated area to be laid out upon, which typically takes up a large two dimensional area of a room, causes obstruction to persons traversing or utilising the room, and is typically required to be disassembled and packed away when not in use in order to maximise overall utility of the space/zone.

In embodiments of the system, the track extension elements 1370*a*, 1370*b* and 1370*c* can be provided as slalom gates, and users are required to drive the toy vehicle therethrough, and cannot progress to a next gate until passing through a previous gate. Alternatively, a user may be required to re-enter and pass through the tubular track 1340 in order to be eligible to attempt to pass through the gates again.

In other embodiments, there may be provided electronic detectors for determining if a toy vehicle does successfully pass through a gate, and there may be provided functionality for electronic score keeping of successful passes though gates.

Two or more vehicles can be utilised at the same time, and a race type game may ensue whereby persons may compete against each other in order to pass through as many gates within a predefined time period. Numerous play/game schemes may be implemented for the system, and various configurations may be deployed to increase the difficulty and enhance player interest.

Figure 14:
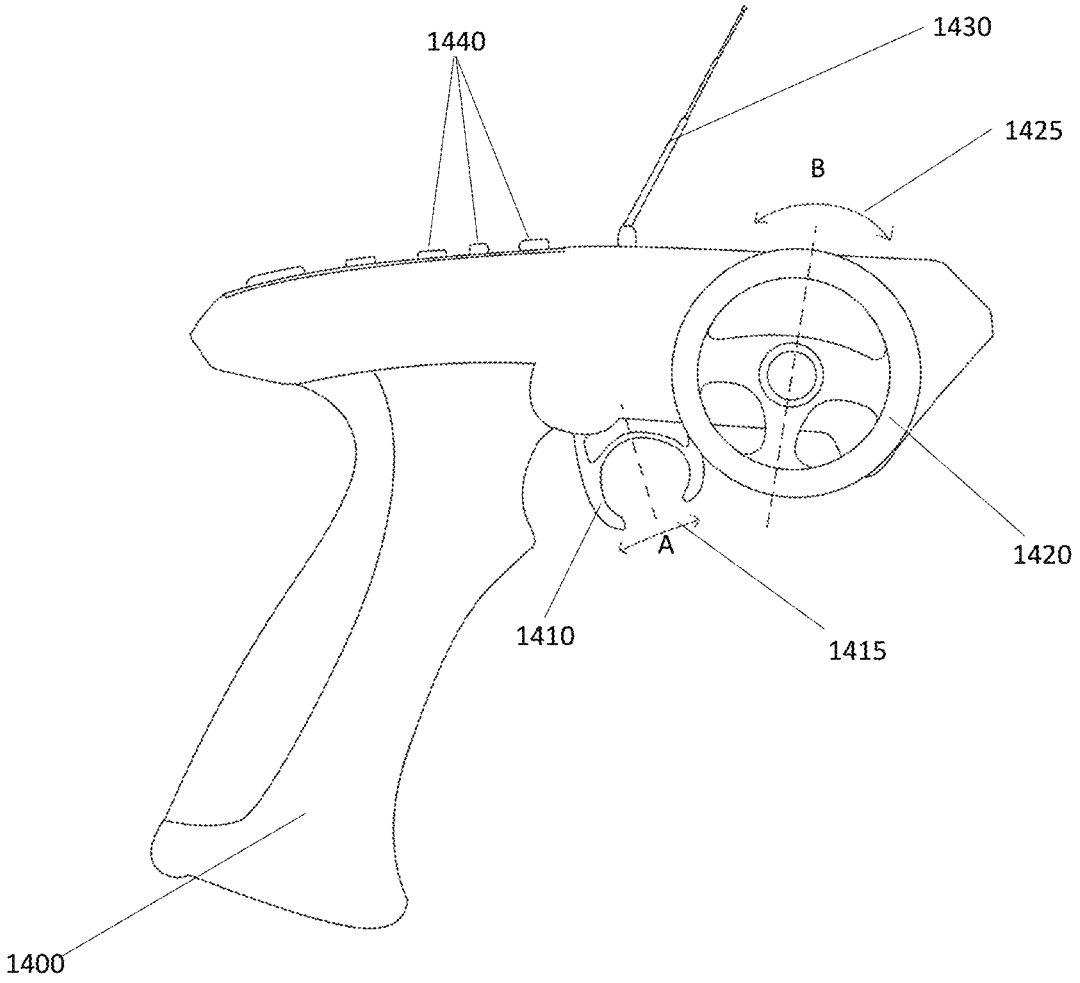
FIG. 14 shows a side view of a hand-held remote control device for use in conjunction with a toy vehicle in accordance with the present invention.

Referring to FIG. 14, there is shown a hand-held remote control device 1400 for use in conjunction with a toy vehicle in accordance with the present invention. The device 1400 includes a trigger control 1410 moveable forward and backwards in the direction 1415 of arrow A.

A user may urge the trigger control 1410 in a forward direction to drive the toy vehicle in a first direction, and may urge the trigger control 1410 in the reverse direction to drive the toy vehicle in a second opposite direction, as well as vary the speed of the toy vehicle.

A steering wheel 1420 is provided, which is rotatable 1425 in a clockwise direction to steer the toy vehicle in a first direction, and which is rotatable in an anti-clockwise direction to steer the toy vehicle in the opposite direction to the first direction.

The device includes an antenna 1430 for providing wireless control of the toy vehicle, and buttons 1440 for changing modes and invoking optional features and the like.

In accordance with the present invention as described above an in reference to the above embodiments, there is provided a toy vehicle which is capable of being operable both within a tubular track and on a planar ground surface external of and extraneous to such a tubular track.

Although the term "planar" has been used with reference to the area external of the tubular track, those skilled in the art will understand that the planar surface may include undulations and inclinations, and the term "planar" does not preclude three dimensional planar surface. As such, the term "planar" in the present invention is not limited or restricted to two dimensional planar playing areas.

In particular, embodiments of the present invention provide for a toy vehicle and track system therefor, including a tubular track, wherein the toy vehicle is operable and is capable of at least both of the following:

(i) Traversing substantial bends when travelling through a tubular track without impingement or jamming and without loss of traction; and (ii) Being both drivable and steerable on a planar surface outside of the tubular track upon exiting the tubular track, whereby the planar surface may include undulations or inclinations.

(iii) Irrespective of the orientation of the vehicle when exiting the elongate tubular track, the toy vehicle is immediately both drivable and steerable on a planar surface outside without the need for determining which wheels are engaged with the ground or the orientation of the vehicle, or include any sensor type system to determine which wheels are engaged with the ground surface or the like for example.

By providing a toy vehicle and track system with the attributes of all (i), (ii) and (iii), the present invention provides a robust, elegant and versatile solution to deficiencies, limitations, complications and inefficiencies of toy vehicles and track systems of the prior art.

Advantageously, irrespective of the orientation of the toy vehicle about its longitudinal central axis upon exiting the tubular track and being disposed on the extraneous planar surface outside of the tubular track, the toy vehicle is both drivable and steerable on such an extraneous planar surface.

Furthermore and advantageously, the drivability and steerability of the toy vehicle of the present invention is not altered or influenced by the orientation of the vehicle upon it exiting the elongating tubular track, and the novel and innovative arrangement of the translational elements and motors controlling such translational elements, provides the significant advantage and benefit of obviating the necessity of the requirement of determining which wheels are engaged with the ground or the orientation of the vehicle so that appropriate wheels are powered or driven to provide steerability.

Such innovation as provided by the present invention provides a toy vehicle having driveability and steerability with:

(i) superior inherent driveability and steerability without reliance on a sensor system or arrangement;

(ii) increased operable reliability as a result of obviation of a sensor system or orientation determination system or sensor;

(iii) ease of manufacture and assembly by less componentry during the assembly process (iv) a control system with increased reliability due to less circuitry and input and processing requirements;

(v) reduced manufacturing costs due to decreased componentry;

(vi) reduced unit costs, due to less components as well as lower complexity control system; and (vii) an overall more robust, reliable, simplistic driveability and steerability function and componentry thereof for a toy vehicle.

Furthermore, the present invention provides for a tubular track system which can also be configured in the vertical dimension, thus allowing an increased efficiency of usable space in which the system may be deployed. Furthermore, in an embodiment having track extension elements, there is provided a system usable in a larger two dimensional area such as a room, in addition to the third vertical dimension, without causing disruption and inconvenience by physically occupying a relatively large two dimensional area, such as is typically required by track systems of the prior art.

A toy vehicle capable of travel through a non-linear three dimensional elongated tubular track and also embodiments which are capable of travelling on a planar surface external to an elongated tubular track and to have controllability and steerability as provided by the present invention is new within the art, and the features which provide for such duality are not suggested within the prior art for such a dual environment functional toy vehicle.

In addition to the above advantages as afforded by the present invention, the following advantages are provided:

Entertainment and Educational Aspects:

For children playing with building and construction toys such as the present invention, either individually, or with friends, or with parents is a proven, age-old, fun way to promote a child's cognitive and academic development.

Active Interaction or Passive Entertainment:

From an active standpoint, building and construction toys actively engage children. Such toys require children to be truly hands-on, and to interact with physical objects and real people in the real world.

From a passive standpoint, playing with many of today's technology based gadgets and devices may also assist in development in certain ways, such as hand-eye co-ordination. However, they also tend to be more passive and can trap children in a virtual world, as well as restrict true three dimensional spatial awareness and cognition.

The present invention can provide children with a platform, such as on the floor, for actively arranging and creating their vision of a raceway and play area.

Skills Development

Playing with building and construction toys requires critical thinking and problem-solving skills. In an ever-changing world with evolving work environments, these are the kinds of skills that are transferable to many future occupations.

Play and Real Life

Playing with building and construction toys encourages children to actively use their mind and their body to entertain themselves, rather than relying on electronic gadgets and devices to provide mainly passive entertainment, which is typically an emulated virtual reality world. As such, the present invention can help prepare children for academic studies, sports and for their adult working life.

The present invention, when used by children, provides for such advantages to children by:

(i) Developing fine motor manipulation and strength: When building a tubular track of the present invention, children have to learn how to manipulate modular pieces of tubing, together with elbow joints, quarter-pipe sections and curved sections to create their own play environment. This promotes fine motor control skills in order to position the pieces within a real three dimensional space.

(ii) Enhancing spatial awareness: Building and construction toys help children enhance their visual-spatial skills which is crucial for reading and writing.

(iii) Encouraging critical thinking and reasoning: These skills can help children prepare for a useful and satisfying place in society.

(iv) Requiring focus and patience: Children need to work steadily and carefully to successfully realize their design creations.

(v) Stimulating children's imagination: Building and construction toys allow children to create their own unique play environments. Using their imagination aids cognitive, academic, language and social development.

(vi) Building confidence and self-esteem: Completing a project of their own imagined design creates a sense of pride in their achievement that is not attainable in many other ways. This feeling of pride is earned. It isn't something that can simply be bought or given. These types of accomplishments create a sense of self belief for a child.

(vii) Developing problem solving and decision-making skills: Figuring out a solution to a problem, either by trial and error, or by first formulating a plan or approach strategy, can assist in developing decision-making skills.

Whether the plan is totally or partially successful is not the most important outcome. More important is the process, because it encourages an ability to think critically and to make calculated decisions, and to readjust a design as necessary.

(viii) Introducing science principles: Through building, children observe physical principles in action and make their own discoveries about how things work and react in the real, physical world.

(ix) Developing mathematical skills. Pipe and quarter-pipe lengths are in simple ratios to one another and elbow pieces are at set angles. All these modular components can be combined in a multitude of possible combinations to form various environments. Figuring out a design requires skills such as counting, adding and subtracting as well as thinking about basic geometry.

(x) Encouraging socialization skills: Playing with others while creating and completing a physical construction project helps develop teamwork and cooperation skills. These are skills that are valuable throughout life, including in an adult workplace.

What is claimed:

1. A toy vehicle having a longitudinal central axis aligned in a direction of travel and for travel through a passageway of an elongated tubular track having a non-linear pathway which extends in three dimensions and which at least partly confines said toy vehicle, said toy vehicle comprising:

a first plurality of translational elements comprising two+2n, wherein n=1 or more, translational elements spaced about the longitudinal central axis of the toy vehicle for engagement with the inner surface of the elongated tubular track; and a second plurality of translational elements comprising two+2m, wherein m=1 or more, translational elements spaced about the longitudinal central axis of the toy vehicle for engagement with the curved inner surface of the elongated tubular track, wherein each of the translational elements of the first plurality of translational elements and each of the translational elements of the second plurality of translation elements are independently moveable in relation to each other and are biased in at least an outward radial direction from the longitudinal central axis of the toy vehicle, and a control system for controlling at least the operable rotational speed of at least two translational elements, wherein said at least two translational elements are drive translational elements;

wherein upon the toy vehicle travelling through the passageway of the elongated tubular track the translational elements are urged towards the inner surface of the elongated tubular track and such that at least one of the drive translational elements is urged against and maintained in contact with the inner surface of the elongated tubular track such that the rotation of said at least one of the drive translational elements urges the toy vehicle through the elongated tubular track;

wherein upon the toy vehicle travelling through a portion of the passageway of the elongated tubular track having a non-linear pathway, the translational elements move relative to the longitudinal central axis and are urged towards the longitudinal central axis such that the toy vehicle is prevented from impinging upon the inner surface of the elongated tubular track such that said at least one of the drive translational elements is maintained against the inner surface of the elongated tubular track; and wherein upon the toy vehicle exiting the elongated tubular track towards and onto a planar surface and being unconstrained within the elongated tubular track:

(i) the toy vehicle rotates under effect of gravity about the longitudinal central axis such that said drive translational elements are operably engaged with the planar surface; and (ii) the control system operably controls the rotational speed of said drive translational elements, such that the toy vehicle is drivable, and such that the toy vehicle is steerable on the planar surface by providing differential rotational speeds between the translational elements.

2. A toy vehicle according to claim 1, wherein the number of translational elements of the first plurality of translational elements equals the number of translational elements of the second plurality of translational elements.

3. A toy vehicle according to claim 1, wherein each translational element of the first plurality of translational elements is collinear with a corresponding translational element of the second plurality of translational elements in the direction of the longitudinal central axis.

4. A toy vehicle according to claim 1, wherein the first plurality of translational elements comprises 4 translational elements, and wherein the second plurality of translational elements comprises 4 translational elements.

5. A toy vehicle according to claim 1, wherein the drive translational elements are translational elements of at least the same plurality of translational element.

6. A toy vehicle according to claim 1, wherein the drive translational elements comprises a first set of drive translational elements and a second set of drive translational elements.

7. A toy vehicle according to claim 6, wherein the first set of drive translational elements and a second set of drive translational elements are of at least a same plurality of translational elements.

8. A toy vehicle according to claim 7, wherein the first set of drive translational elements and a second set of drive translational elements are of the same plurality of translational elements, and wherein the drive translational elements of the first set of drive translational and of the second set of drive translational elements are disposed alternately about the longitudinal axis.

9. A toy vehicle according to claim 8, wherein the drive translational elements of the first set of drive translational are driven by a first motor and the drive translational elements of the second set of drive translational elements are driven by a second motor.

10. A toy vehicle according to claim 9, wherein the first set of drive translational elements and a second set of drive translational elements are of both the first and the second plurality of translational elements.

11. A toy vehicle according to claim 10, wherein all translational elements of the first and the second plurality of translational elements are drive translational elements.

12. A toy vehicle according to claim 1, wherein the translational elements of the first and the second plurality of translational elements are drive translational elements are equally spaced about the longitudinal axis.

13. A toy vehicle according to claim 1, wherein the translational elements are comprised of two wheels.

14. A tubular track system, comprising an elongated tubular track for use in conjunction with the toy vehicle according to claim 1.

15. A tubular track system according to claim 14, wherein the tubular track system is modular.

16. A tubular track system according to claim 14, wherein the tubular track system is a three-dimensional arrangement.

17. A tubular track system according to claim 14, wherein the tubular track system is an open system opening to a planar surface, to provide entry of the toy vehicle into the tubular track system from a planar surface and exit from the tubular track system to the planar surface.

18. A tubular track system according to claim 14, wherein the tubular track system further includes at least one flared element for entry and for exit of the toy vehicle in relation to the tubular track system.

19. A tubular track system according to claim 14, further including peripheral containment members, whereby the peripheral containment members define a play area therein and comprises a generally elongated perimeter structure having a concave inner lip portion extending upwardly for containing the toy vehicle within the play area.

* * * * *